US007007739B2

(12) United States Patent
Shaber

(10) Patent No.: US 7,007,739 B2
(45) Date of Patent: Mar. 7, 2006

(54) DIRECT CHILLED METAL CASTING SYSTEM

(75) Inventor: Craig L. Shaber, Spokane Valley, WA (US)

(73) Assignee: Wagstaff, Inc., Spokane, WA (US)

( * ) Notice: Subject to any disclaimer, the term of this patent is extended or adjusted under 35 U.S.C. 154(b) by 0 days.

(21) Appl. No.: 10/789,391

(22) Filed: Feb. 28, 2004

(65) Prior Publication Data

US 2005/0189087 A1 Sep. 1, 2005

(51) Int. Cl.
*B22D 11/124* (2006.01)

(52) U.S. Cl. ..... 164/487; 164/444

(58) Field of Classification Search ..... 164/487, 164/444

See application file for complete search history.

(56) References Cited

U.S. PATENT DOCUMENTS

| | | | |
|---|---|---|---|
| 4,009,750 | A | 3/1977 | Fekete et al. |
| 4,122,890 | A | 10/1978 | Atkins et al. |
| 4,351,384 | A | 9/1982 | Goodrich |
| 4,473,105 | A | 9/1984 | Pryor |
| 4,474,225 | A | 10/1984 | Yu |
| 4,530,394 | A | 7/1985 | Yarwood et al. |
| 4,572,280 | A | 2/1986 | Haller |
| 4,693,298 | A | 9/1987 | Wagstaff |
| 4,892,134 | A | 1/1990 | Zuber |
| 4,987,950 | A | 1/1991 | Yu |
| 5,027,882 | A | 7/1991 | Mueller et al. |
| 5,065,945 | A | 11/1991 | Vidusek et al. |
| 5,148,856 | A | 9/1992 | Mueller et al. |
| 5,257,659 | A | 11/1993 | Maag |
| 5,518,063 | A | 5/1996 | Wagstaff et al. |
| 5,582,230 | A | 12/1996 | Wagstaff et al. |
| 5,632,323 | A | 5/1997 | Naess, Jr. et al. |
| 5,685,359 | A | 11/1997 | Wagstaff et al. |
| 6,056,041 | A | 5/2000 | Caron et al. |
| 6,142,396 | A | 11/2000 | Gallus |
| 6,374,901 | B1 | 4/2002 | Frank et al. |
| 6,491,087 | B1 | 12/2002 | Tilak |
| 6,513,574 | B1 | 2/2003 | Saether et al. |
| 6,543,122 | B1 | 4/2003 | Perkins et al. |
| 6,546,995 | B1 | 4/2003 | Wagstaff |
| 6,557,622 | B1 | 5/2003 | Frank et al. |
| 6,561,440 | B1 | 5/2003 | Hofherr |
| 6,675,870 | B1 | 1/2004 | Tilak |
| 6,808,009 | B1 * | 10/2004 | Anderson ..... 164/459 |
| 6,857,464 | B1 | 2/2005 | LeBlanc et al. |

* cited by examiner

*Primary Examiner*—Jonathan Johnson
*Assistant Examiner*—Len Tran
(74) *Attorney, Agent, or Firm*—Wells St. John P.S.

(57) ABSTRACT

A molten metal mold casting system with a cooling system which maintains an approximately equal coolant flow rate while altering flow characteristic of the coolant flow discharged toward the castpart to alter the cooling affects on the emerging castpart. The heat transfer at the center surface portion of the castpart is reduced for some low thermal conductivity alloy metals, which reduces the butt curl during casting.

35 Claims, 18 Drawing Sheets

DIRECT CHILLED METAL CASTING SYSTEM

CROSS REFERENCE TO RELATED APPLICATION

This application does not claim priority from any other application.

TECHNICAL FIELD

This invention pertains to a molten metal mold casting system for use in the casting of ferrous and non-ferrous molds. More particularly, this invention provides a cooling system which generally maintains an approximately equal intake flow rate through coolant apertures or baffles, while reducing the heat transfer or cooling at fractional surface portions of the castpart, thereby reducing butt curl and/or any other undesired effects which are not desired during casting of castparts and metals.

BACKGROUND OF THE INVENTION

Metal ingots, billets and other castparts are typically formed by a casting process which utilizes a vertically oriented mold situated above a large casting pit beneath the floor level of the metal casting facility, although this invention may also be utilized in horizontal molds. The lower component of the vertical casting mold is a starting block. When the casting process begins, the starting blocks are in their upward-most position and in the molds. As molten metal is poured into the mold bore or cavity and chilled (typically by water), the starting block is slowly lowered at a predetermined rate by a hydraulic cylinder or other device. As the starting block is lowered, solidified metal or aluminum emerges from the bottom of the mold and ingots, rounds or billets of various geometries are formed, which may also be referred to herein as castparts.

While the invention applies to the casting of metals in general, including without limitation aluminum, brass, lead, zinc, magnesium, copper, steel, etc., the examples given and preferred embodiment disclosed may be directed to aluminum, and therefore the term aluminum may be used throughout for consistency even though the invention applies more generally to metals. This type of casting wherein fluid (gas or liquid) is applied directly to an emerging castpart is generally referred to as direct chilled or direct cooled casting.

While there are numerous ways to achieve and configure a vertical casting arrangement, FIG. 1 illustrates one example. In FIG. 1, the vertical casting of aluminum generally occurs beneath the elevation level of the factory floor in a casting pit. Directly beneath the casting pit floor 101*a* is a caisson 103, in which the hydraulic cylinder barrel 102 for the hydraulic cylinder is placed.

As shown in FIG. 1, the components of the lower portion of a typical vertical aluminum casting apparatus, shown within a casting pit 101 and a caisson 103, are a hydraulic cylinder barrel 102, a ram 106, a mounting base housing 105, a platen 107 and a starting block base 108 (also referred to as a starting head or bottom block), all shown at elevations below the casting facility floor 104.

The mounting base housing 105 is mounted to the floor 101*a* of the casting pit 101, below which is the caisson 103. The caisson 103 is defined by its side walls 103*b* and its floor 103*a*.

A typical mold table assembly 110 is also shown in FIG. 1, which can be tilted as shown by hydraulic cylinder 111 pushing mold table tilt arm 110*a* such that it pivots about point 112 and thereby raises and rotates the main casting frame assembly, as shown in FIG. 1. There are also mold table carriages which allow the mold table assemblies to be moved to and from the casting position above the casting pit.

FIG. 1 further shows the platen 107 and starting block base 108 partially descended into the casting pit 101 with ingot or castpart 113 being partially formed. Castpart 113 is on the starting block base 108, which may include a starting head or bottom block, which usually (but not always) sits on the starting block base 108, all of which is known in the art and need not therefore be shown or described in greater detail. While the term starting block is used for item 108, it should be noted that the terms bottom block and starting head are also used in the industry to refer to item 108, bottom block is typically used when an ingot is being cast and starting head when a billet is being cast.

While the starting block base 108 in FIG. 1 only shows one starting block 108 and pedestal 105, there are typically several of each mounted on each starting block base, which simultaneously cast billets, special shapes or ingots as the starting block is lowered during the casting process, as shown in later Figures and as is known.

When hydraulic fluid is introduced into the hydraulic cylinder at sufficient pressure, the ram 106, and consequently the starting block 108, are raised to the desired elevation start level for the casting process, which is when the starting blocks are within the mold table assembly 110.

The lowering of the starting block 108 is accomplished by metering the hydraulic fluid from the cylinder at a predetermined rate, thereby lowering the ram 106 and consequently the starting block at a predetermined and controlled rate. The mold is controllably cooled or chilled during the process to assist in the solidification of the emerging ingots or billets, typically using water cooling means.

There are numerous mold and casting technologies that fit into mold tables, and no one in particular is required to practice the various embodiments of this invention, since they are known by those of ordinary skill in the art.

Mold tables come in all sizes and configurations because there are numerous and differently sized and configured casting pits over which mold tables are placed. The needs and requirements for a mold table to fit a particular application therefore depends on numerous factors, some of which include the dimensions of the casting pit, the location(s) of the sources of water and the practices of the entity operating the pit.

The upper side of the typical mold table operatively connects to, or interacts with, the metal distribution system. The typical mold table also operatively connects to the molds which it houses.

When metal is cast using a continuous cast vertical mold, the molten metal is cooled in the mold and continuously emerges from the lower end of the mold as the starting block base is lowered. The emerging billet, ingot or other configuration is intended to be sufficiently solidified such that it maintains its desired shape. There is typically an air gap between the emerging solidified metal and the permeable ring wall. Below that, there is also a mold air cavity between the emerging solidified metal and the lower portion of the mold and related equipment.

Since the casting process generally utilizes fluids, including lubricants, there are conduits and/or piping designed to deliver the fluid to the desired locations around the mold cavity. Although the term lubricant will be used throughout this specification, it is understood that this also means fluids of all types, whether a lubricant or not, and may also include release agents.

Working in and around a casting pit and molten metal can be potentially dangerous and it is desired to continually find ways to increase safety and minimize the danger or accident potential to which operators of the equipment are exposed.

Butt curl is a known and undesired phenomena incurred during the casting of some metals and/or shapes, and is generally caused by the shrinking of some portions of the castpart relative to other portions. Excessive butt curl can result in breakout or bleedout situations in which molten metal escapes during the molding process and requires that the casting be immediately aborted. In casting shapes such as ingots, especially when casting metal alloys which have a lower thermal conductivity, there is a tendency for butt curl to occur more and to a higher degree. For instance, each of the alloys has a different liquidus to solidus region and a thermal conductivity. Some of these alloys, such as the ones which have higher magnesium contents, also have much lower thermal conductivities. As a result, it is more difficult to form a uniform water vapor barrier or film barrier. The center of these ingots tend to operate in nucleate boiling sooner than the rest of the ingot, which is not desirable.

It is desirable to maintain a higher metal temperature in the center surface portions of the ingot castpart to reduce temperature gradients and to reduce the incidence and/or magnitude of butt curling.

As one would expect with a well recognized problem, several attempts have been made to reduce the incidence and magnitude of butt curl. However the Applicant is not aware of any such attempts or solutions which also maintained a relatively constant flow rate through the various variable coolant discharge apertures. For instance one solution was to increase the cooling in the quarter portions by increasing the baffle and spray hole cross-sections in order to increase the cooling in those areas to reduce the gradient between those areas and the center surface portions. The increase in flow through the larger apertures in the quarter portions may result in other undesired effects.

The casting and cooling process leaves what those skilled in the art refer to as steam stains, which are patterns or stains on the exterior of the castpart from casting, and the higher the steam stain in any given portion of the castpart such as quarter portion or center surface portion from the bottom of the castpart, the longer that portion remained at a higher temperature. In casting ingots as one example, it is therefore desired to have a steam stain pattern in which the steam stains are higher in the center surface portions (a fractional portion) of the castpart than toward the ends or in what is referred to as the quarter portions. In casting other shapes, it may be desired to have one steam stain in a first fractional surface location, and a second steam stain pattern in a second fractional surface location. In fact there several different steam stain patterns or heights may be desired for one particular castpart and this invention provides the ability to accomplish this.

In one aspect of the invention, it is an object to provide an improved cooling system for certain shaped castparts or for certain metal or alloy compositions.

It is an object of some embodiments of this invention to provide a cooling system which leaves a steam stain which is higher in magnitude, or runs higher up the castpart, in the center surface portions than in the end or quarter portions.

It is an object of some embodiments of this invention to provide a cooling and casting system which reduces butt curl, even for relatively low thermally conduct metal alloys.

BRIEF DESCRIPTION OF THE DRAWINGS

Preferred embodiments of the invention are described below with reference to the following accompanying drawings.

FIG. 4 is a prospective view of a portion of a mold framework with two sets of coolant discharge apertures located thereon;

FIG. 10 is a part schematic and part cross-sectional elevation view, illustrating steam stains and butt curl on an ingot castpart;

FIG. 27 is a schematic cross-sectional view of a portion of a castpart, illustrating another embodiment of this invention utilized thereon wherein a coolant framework includes an intermediate coolant reservoir.

DETAILED DESCRIPTION OF THE PREFERRED EMBODIMENTS

Figure 1:
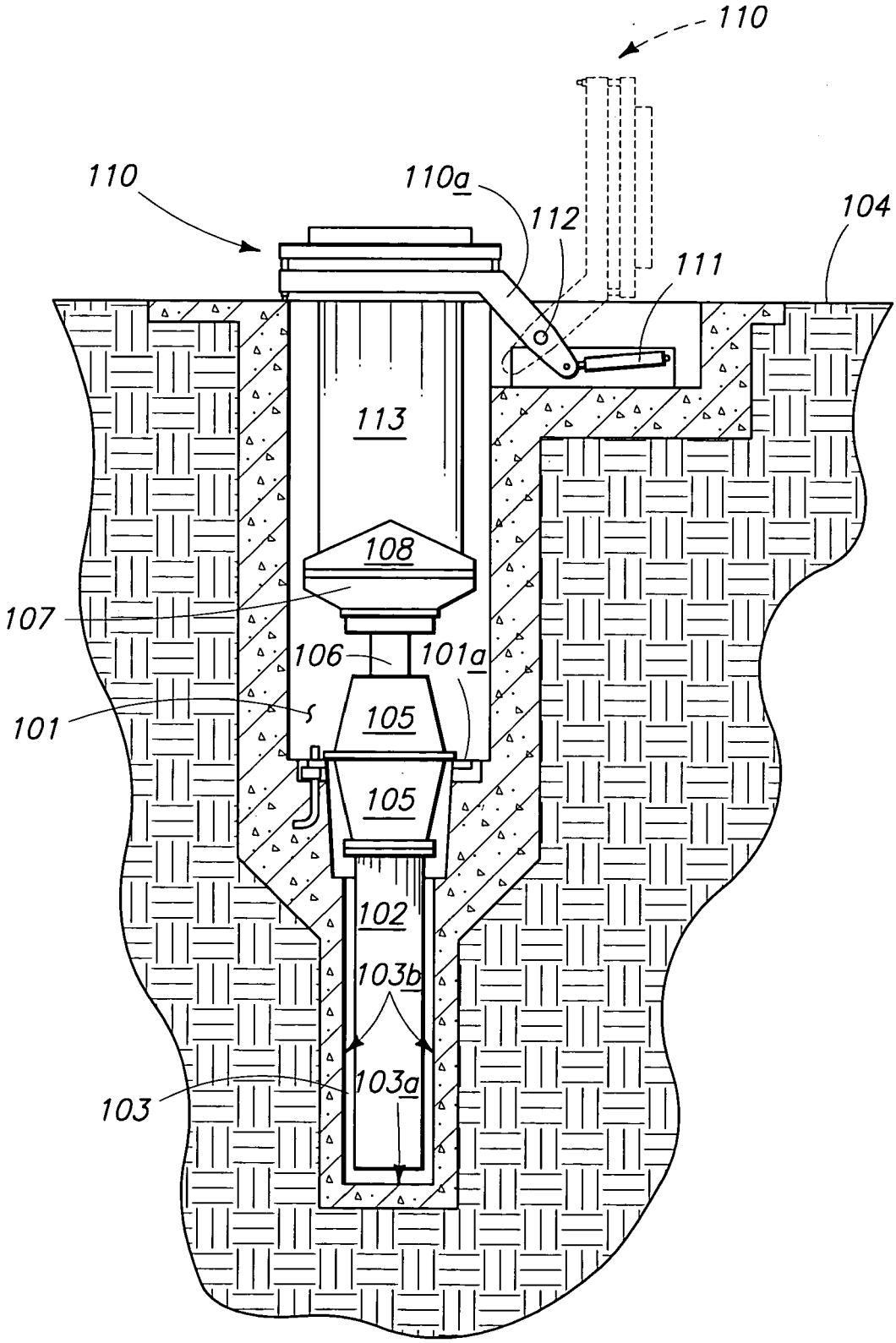
FIG. 1 is an elevation view of a vertical casting pit, caisson and metal casting apparatus in which the invention may be used.

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

It is to be understood that this invention applies to and can be utilized in connection with various types of metal pour technologies and configurations. It is further to be understood that this invention may be used on horizontal or vertical casting devices. The mold therefore must merely be able to receive molten metal from a source of molten metal, whatever the particular source type is. The mold cavities in the mold must therefore be oriented in fluid or molten metal receiving position relative to the source of molten metal.

For purposes of this invention, when the term "coolant discharge aperture" is utilized, it includes the coolant orifice or aperture in what is sometimes referred to as the baffle, the spray hole and the like, up to where the coolant is discharged from said aperture toward the emerging castpart.

For purposes of this invention, the term "first coolant flow rate" is used to indicate an approximate flow rate or average flow rate through a first plurality of coolant discharge apertures, and is not intended to require that the flow rate in each of the first plurality of coolant discharge apertures be identical, but instead are approximately the same, relative to differences when compared relative to other coolant flow rates such as the "second coolant flow rate". There may therefore be variances within the "first coolant flow rate" even beyond tolerance type variances, within the scope of this invention.

For purposes of this invention, the term "second coolant flow rate" is used to indicate an approximate flow rate or average flow rate through a second plurality of coolant discharge apertures, and is not intended to require that the flow rate in each of the second plurality of discharge apertures be identical, but instead are approximately the same, relative to differences when compared relative to other coolant flow rates such as the "first coolant flow rate". There may therefore be variances within the "second coolant flow rate" even beyond tolerance type variances, within the scope of this invention.

The terms "first coolant flow rate" and "second coolant flow rate" as used herein, refer to the input flow rate for the orifice, whether provided in one or more parts. In a typical current configuration, an input orifice or a baffle may be utilized to receive coolant from a common reservoir or from a predetermined reservoir or source of coolant, at a common pressure. The size of the input baffle, conduit or orifice may then determine the flow rate and other flow characteristics of coolant flow through the orifice.

As used herein for purposes of this invention, the term "quarter portion" or "quarter surface portion" in relation to a castpart being molded, means the approximate outer one-fourth or quarter section on the outer ends of the castpart. For instance, FIG. 8 (among others) shows an ingot with a quarter portion on each side and two center surface portions between the quarter portions. It will also be appreciated by those of ordinary skill in the art that while an ingot shape is shown in the drawings, this invention has potential application with a number of different castparts of various shapes and sizes. The term "fractional portion" or "fractional surface portion" refers to any fraction of the whole portion or whole surface portion.

It will further be appreciated and understood by those of ordinary skill in the art that the terms fractional surface portion, quarter portion, one-third and center surface portion are used for convenience and for setting up boundaries for locations of coolant spray apertures, and so long as there are at least a plurality in the portion identified, it is claimed as the invention even though other coolant discharge apertures may not also fit that criteria or flow characteristics. For instance in FIG. 25, a schematic with one-third portion is illustrated. In the Figures that follow, several may show the castpart divided into two one-quarter portions and one or two center surface portions, which are for convenience and those of ordinary skill in the art will understand and appreciate there are variations from that for a given application.

As used herein for purposes of this invention, the term "center surface portion" or "center portion" in relation to a castpart being molded, means the surface area generally or approximately between the quarter portions of the castpart, which are centrally located. As one example but not intending to set very precise boundaries, FIG. 8 (among others) illustrates two quarter portions and two center surface portions. The two center surface portions may also be referred to simply as one central portion.

When the term "discharged toward" is used in this invention in referring to coolant discharged toward a castpart, at a particular flow rate or velocity, the flow rate or velocity is preferably measured or calculated at, proximate or near the discharge of the orifice. Furthermore, discharged toward may mean at any angle so long as the coolant is discharged or directed toward the castpart or other liquid or coolant on the castpart.

When the terms first discharge coolant and second discharge coolant are used in this invention, it refers to coolant coming from the first and second pluralities of orifices and not to coolant of a different type or from a different source.

When the cooling framework is described herein as "around the periphery" or "around a perimeter" of the mold cavity, this is to be understood in general terms to be around the periphery or perimeter, and may but need not be completely enclosing or around the complete periphery or perimeter, for purposes of this invention.

The term "uniform internal orifice surfaces" as used herein relative to some embodiments of the invention, means an internal surface of the discharge orifice that is constant in diameter, surface texture, and/or geometry. The altering of such a surface may include for example: using a drill bit to make a larger diameter at or proximate the discharge end of the orifice, which, assuming an approximately equal flow rate, will reduce the velocity of the discharged coolant; using a tap to create internal threads to alter, attenuate or affect the coolant flow (which may reduce the actual amount of coolant discharged and/or may reduce the velocity of the discharged coolant flow) and/or detents in or protrusions on the internal surface.

In some of the embodiments of the invention, the coolant discharge aperture may be comprised of a baffle or input orifice or aperture alone or in combination with what some refer to as a spray hole. The spray hole may be that portion of the coolant discharge aperture, conduit or orifice used to alter the flow characteristics of the coolant flow and the baffle portion may (but need not) be that part used to meter the flow rate. Alternatively, the baffle and the spray hole may be integrated or continuous. It will be appreciated by those of ordinary skill in the art that one may label the baffle as the spray hole, or alter the flow characteristics in the baffle.

One example or embodiment of using a spray hole in combination with a baffle to alter the flow characteristics is to provide a baffle with the same approximate cross-sectional area to achieve relatively uniform coolant flow through each coolant aperture in the baffle, and to combine this with a spray hole operatively attached thereto. The internal configuration of the spray hole would then be altered by any one of a number of ways (larger cross-section, larger diameter, detents, protrusions, etc.) to decrease the velocity of the flow or the volume or flow rate, which in turn tends to decrease the heat transfer to the discharged coolant in the desired area, such as the center surface portion.

In an embodiment of the invention, increasing the cross-sectional area in the spray hole portion or the coolant discharge aperture, to make it larger than the cross-sectional area of the baffle portion of the coolant discharge aperture. This will result in the coolant being discharged toward the castpart at a lower velocity. These alterations may be made to the discharge orifices providing coolant to the center surface portions of the castpart to reduce the heat transfer occurring at that portion of the castpart, which especially for metals with lower thermal conductivity, will result in less butt curl.

In another embodiment of the invention, part of the coolant passing through the coolant discharge aperture (either in a baffle portion, a spray hole portion, or an integrated combination) may be diverted to decrease the volume: of the flow discharged, and/or the velocity of the remaining coolant flow, thereby reducing the heat transfer occurring at that portion of the castpart.

As will be appreciated by those of ordinary skill in the art, decreasing the cooling to the center surface portion of the castpart in many metal alloys will result in higher steam stains in the center surface portion of the castpart from the higher resulting relative temperatures in the center surface portion. It will also be appreciated by those of ordinary skill in the art that having a steam stain profile with higher steam stains in the center surface portion of the castpart will tend to or generally result in decreased butt curl.

The invention disclosed herein may be applied to many different castparts and castparts molded from numerous different types and compositions of metals and materials. The invention may also be utilized in specific desired locations on what are referred to as shaped castparts, which can essentially include any shape castpart, mold and cooling framework. Desired results or improvements have been experienced in the casting of metal alloys which have a lower thermal conductivity (such as what is known as 5083 alloy, a low thermal conductivity aluminum alloy). In the continuous casting using direct chill methods, it is generally desirable to have a more uniform temperature generally across the entire castpart, as opposed to having higher or unacceptable temperature gradients. Higher temperature gradients tend to cause a change to the desired shape of the molded castpart due to expansions and shrinkages which result.

In more substantial or extreme cases of unacceptable butt curling or geometric distortions, the sides of the castpart may sufficiently contract or move inwardly away from the perimeter of the mold and thereby allow molten metal to escape, bleedout or breakout through the resulting gap. This may be referred to as molten metal bleedout and creates an unacceptable and potentially dangerous condition within the mold and the casting pit, requiring that the cast be aborted. The resulting loss in production and run time can be substantial in terms of time and expense.

Alloy metals having higher thermal conductivity better transfer heat internally to maintain a more uniform temperature distribution and fewer or less dramatic unacceptable temperature gradients.

In the industry the term "baffle" is sometimes used to describe an input orifice or an aperture which has a predetermined cross-section and may generally determine the amount of flow or flow rate of coolant through the orifice.

It will also be appreciated by those of ordinary skill in the art that any one of a number of coolants may be used with embodiments of this invention, with no one in particular being required to practice this invention. The preferred coolant is water or a mixture of water and some other gaseous or liquid additive. For instance carbon dioxide may be added to the water for changing the cooling characteristics.

FIG. 1 is described in the background of the invention and will not be further described herein.

Figure 2:
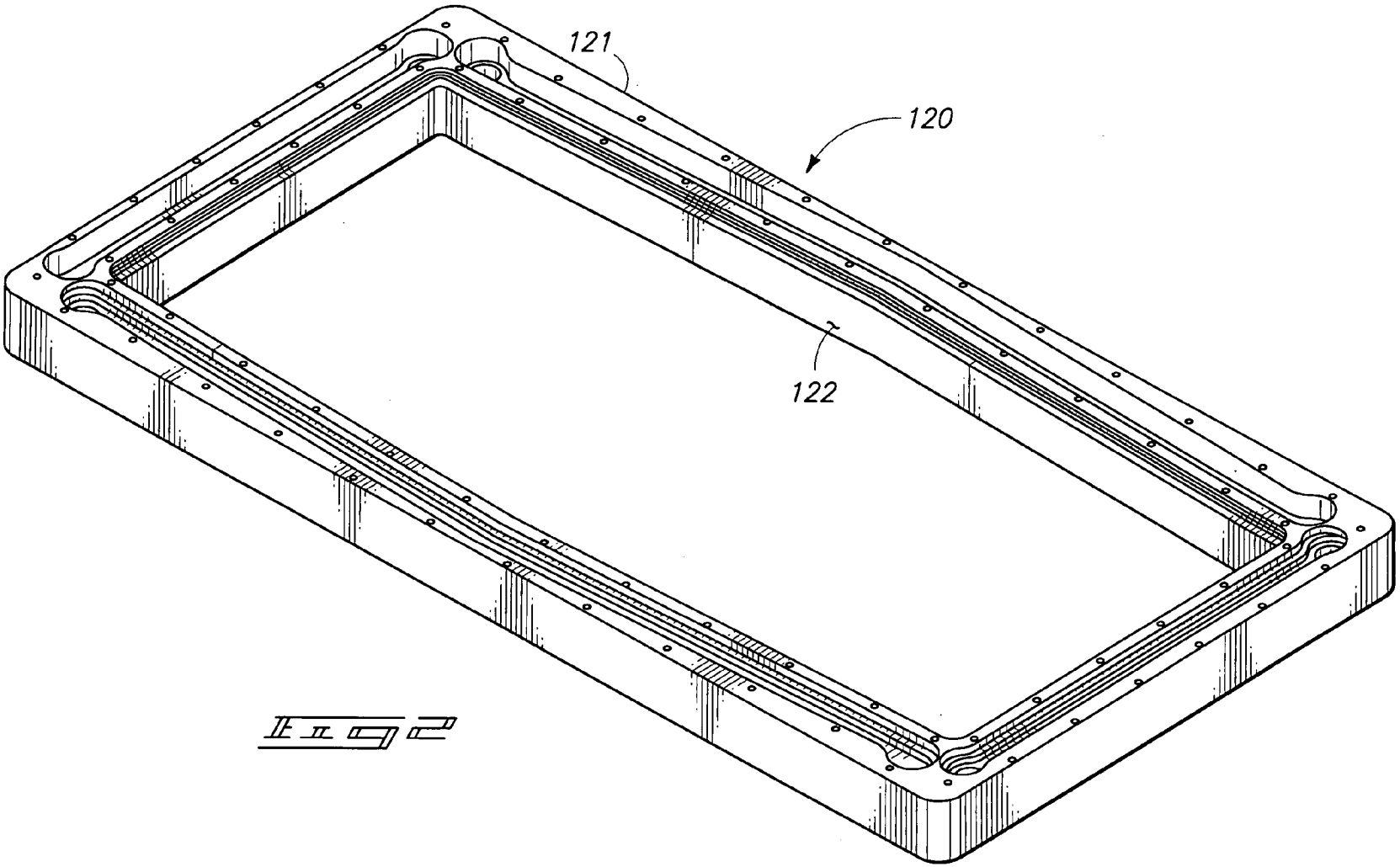
FIG. 2 is a prospective top view of an example of an ingot shaped mold framework and mold cavity.

FIG. 2 is a prospective view of one example of a mold framework 120 shaped to produce rectangular or ingot shaped castparts or cast formats. The mold outlet cavity side 121 and the mold inlet cavity side 122 of the framework is shown, and molten metal would generally be provided or made available through the mold inlet cavity 121 and would exit through the mold outlet cavity 122. It is generally at the mold outlet cavity 122 where coolant is sprayed on or directed to the emerging castpart. The general manufacturing use of such a mold framework 120 is well know by those of ordinary skill in the art and will not be described in further detail herein. Furthermore, more detailed description of such a framework is provided in U.S. Pat. No. 5,582,230, which is hereby incorporated herein by this reference.

Figure 3:
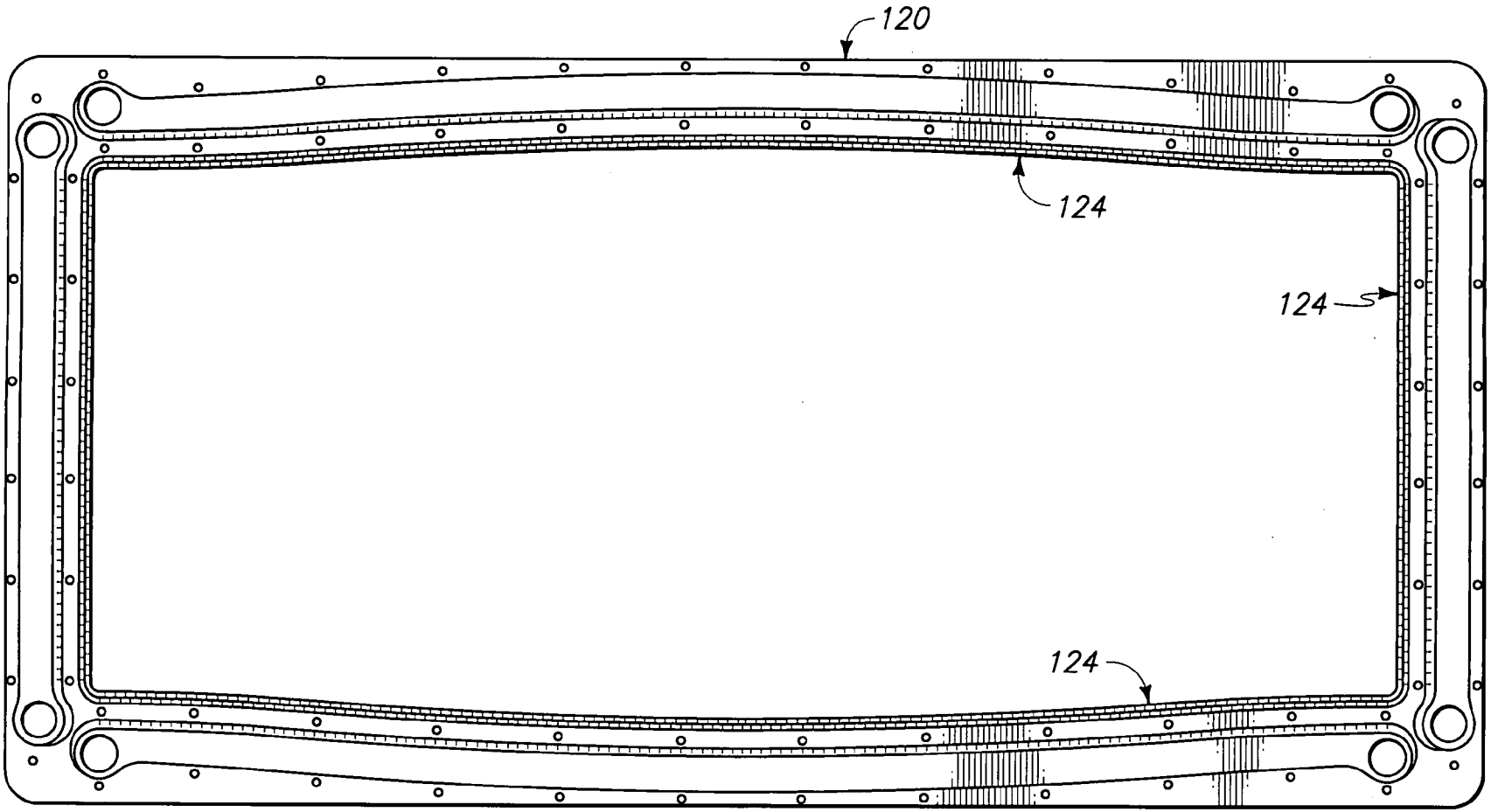
FIG. 3 is a bottom view of the example of the ingot shaped mold framework and mold cavity illustrated in FIG. 2.

FIG. 3 is a bottom view of the example of the ingot shaped mold framework illustrated in FIG. 2, and has a view from the outlet cavity side of the mold framework 120. The inner parameter 124 of the mold framework is also shown in FIG. 3, and generally defining what is referred to as an ingot shape.

FIG. 4 illustrates one of numerous possible mold framework 130 configurations which this invention may be applied in, showing first coolant discharge apertures 131, second coolant discharge apertures 132, first coolant feed discharge aperture 133 and second coolant feed discharge aperture 134.

FIG. 4 is a section or portion of what would be the continuous perimeter framework for the mold and shows a coolant discharger aperture configuration of what is referred to as a split or dual jet spray technology. This configuration utilizes two discharge apertures to discharge coolant toward the emerging castpart, namely discharged apertures 131 and 132. Embodiments of this invention may be utilized in the primary discharge or secondary apertures 132, in the secondary discharge apertures, or the first discharge apertures 131 in FIG. 4.

Figure 5:
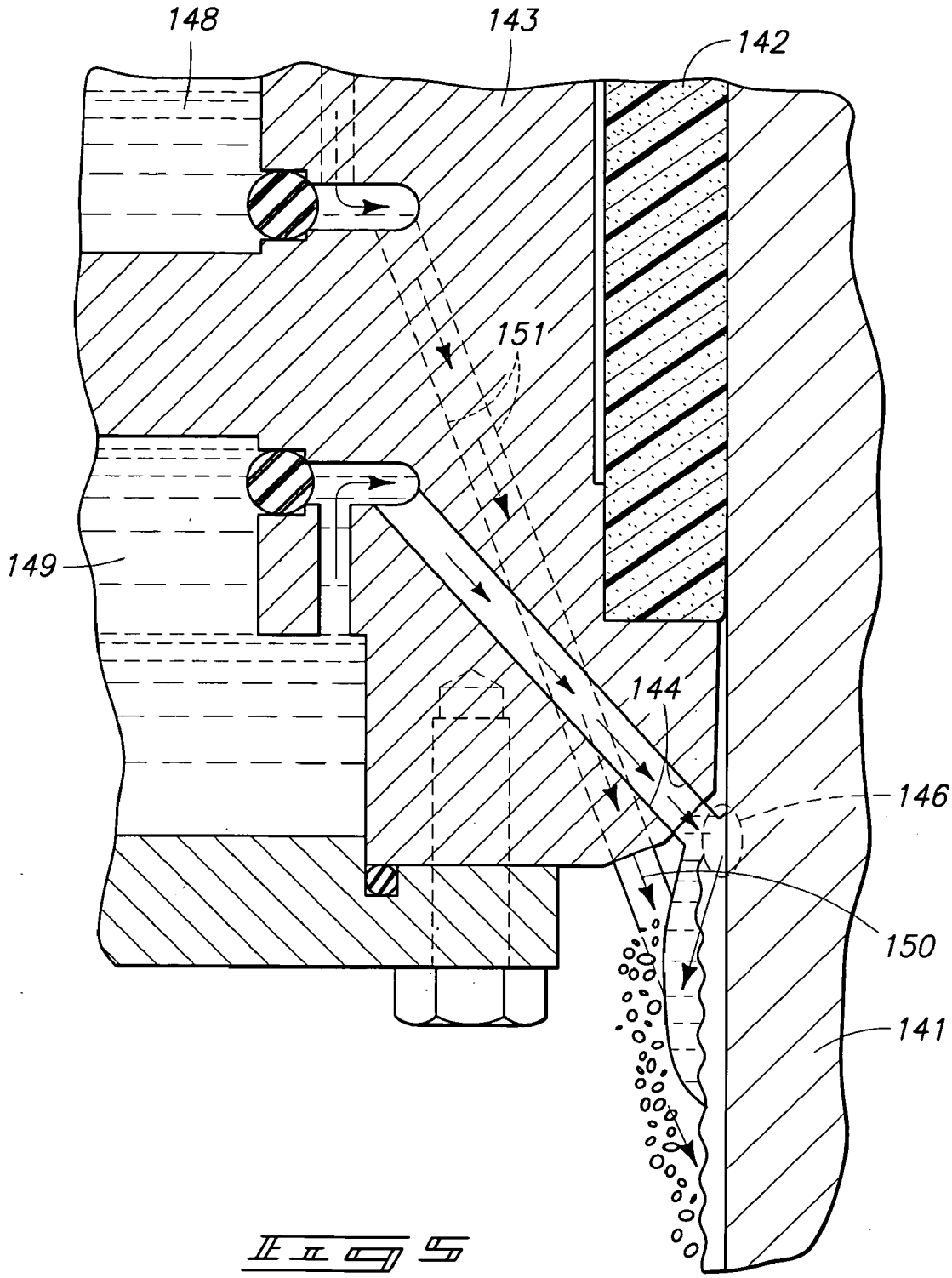
Fig 5 PRIOR ART
FIG. 5 is a part schematic, part cross-sectional view of a prior art mold portion as disclosed in U.S. Pat. No. 5,582,230, illustrating two coolant discharge apertures discharging coolant to the castpart.

FIG. 5 illustrates the split-jet technology and the coolant being sprayed on an emerging castpart 141. FIG. 5 illustrates emerging castpart 141, mold ring 142 supported within framework 143, first coolant discharge aperture 144 and second coolant discharge aperture 151. The coolant discharged from the first coolant discharge aperture 144 contacts the emerging castpart at or about the target zone 146. The coolant then typically moves in the direction of the emerging castpart 141 is moving, and also engages in some splashing coolant as additional coolant is discharged.

It will be appreciated by those of ordinary skill in the art that while this invention may be used with one or two coolant discharge apertures, there is no particular number which needs to be used in order to practice the embodiments of this invention. The examples and illustrations shown herein are for illustrative purposes and not in any way to limit the environment or scope of the invention.

FIG. 5 further illustrates first coolant reservoir 148, second coolant reservoir 149 which supply the coolant for the first coolant discharge aperture 151 and the second coolant discharge aperture 144, respectively. There are numerous general and specific configurations for continuous casting molds, which are generally known by those of ordinary skill in the art, and each one will not be described in any significant detail herein, nor is any one in particular required to practice this invention. FIG. 5 further illustrates coolant discharge aperture 151 within framework 143 and coolant discharged 150 from coolant discharge aperture 151.

Figure 24:
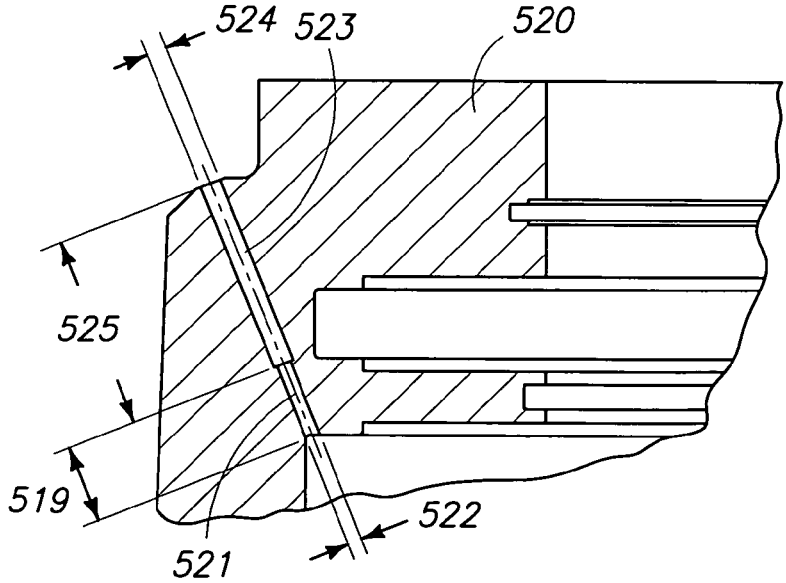
FIG. 24 is a cross-sectional view of a framework with another embodiment of the invention therein.

In a more typical application of the invention, the coolant discharge apertures 151, which are referred to as the secondary apertures, would be altered, as shown more fully in FIG. 24. However it is important to note that this invention may be applied to numerous different scenarios.

Figure 6:
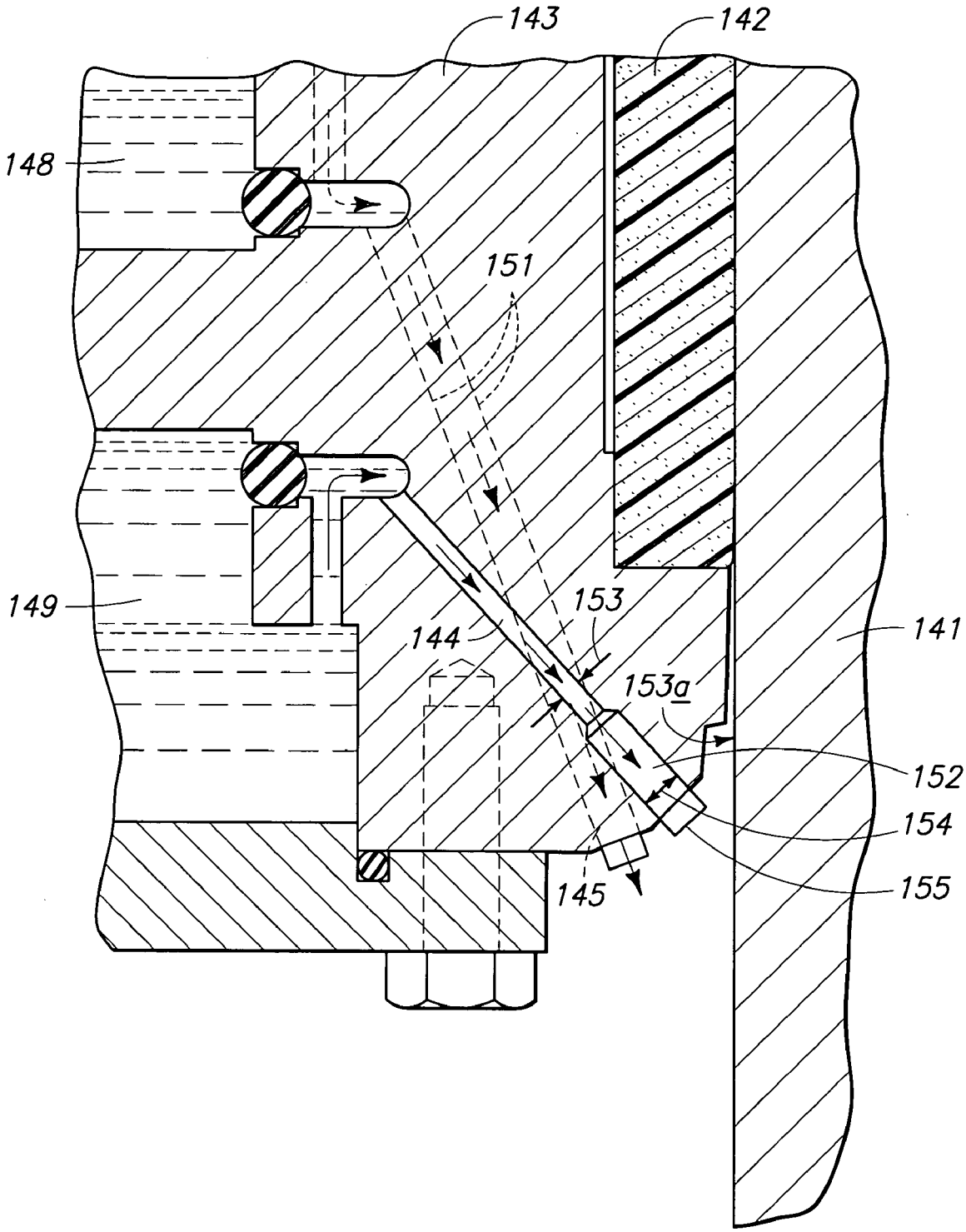
FIG. 6 is a part schematic, part cross-sectional view of a portion of a mold illustrating an embodiment of the invention utilized therein.

FIG. 6 is a part schematic, part cross-sectional view of the invention with a larger cross-sectional area just prior to discharge for one of the coolant discharge apertures. FIG. 6 utilizes many of the same references to item numbers from FIG. 5, and a description will not be repeated herein.

FIG. 6 further illustrates a coolant discharge aperture wherein there is a flow regulating or control section, which may be referred to as a baffle portion, and a second portion nearer the discharge where the diameter has been increased to alter flow characteristics. The baffle portion 144 of the coolant discharge aperture with diameter 153, and a spray hole portion 152 with diameter 154. Coolant discharge 155 is shown being discharged toward castpart 141.

Figure 7:
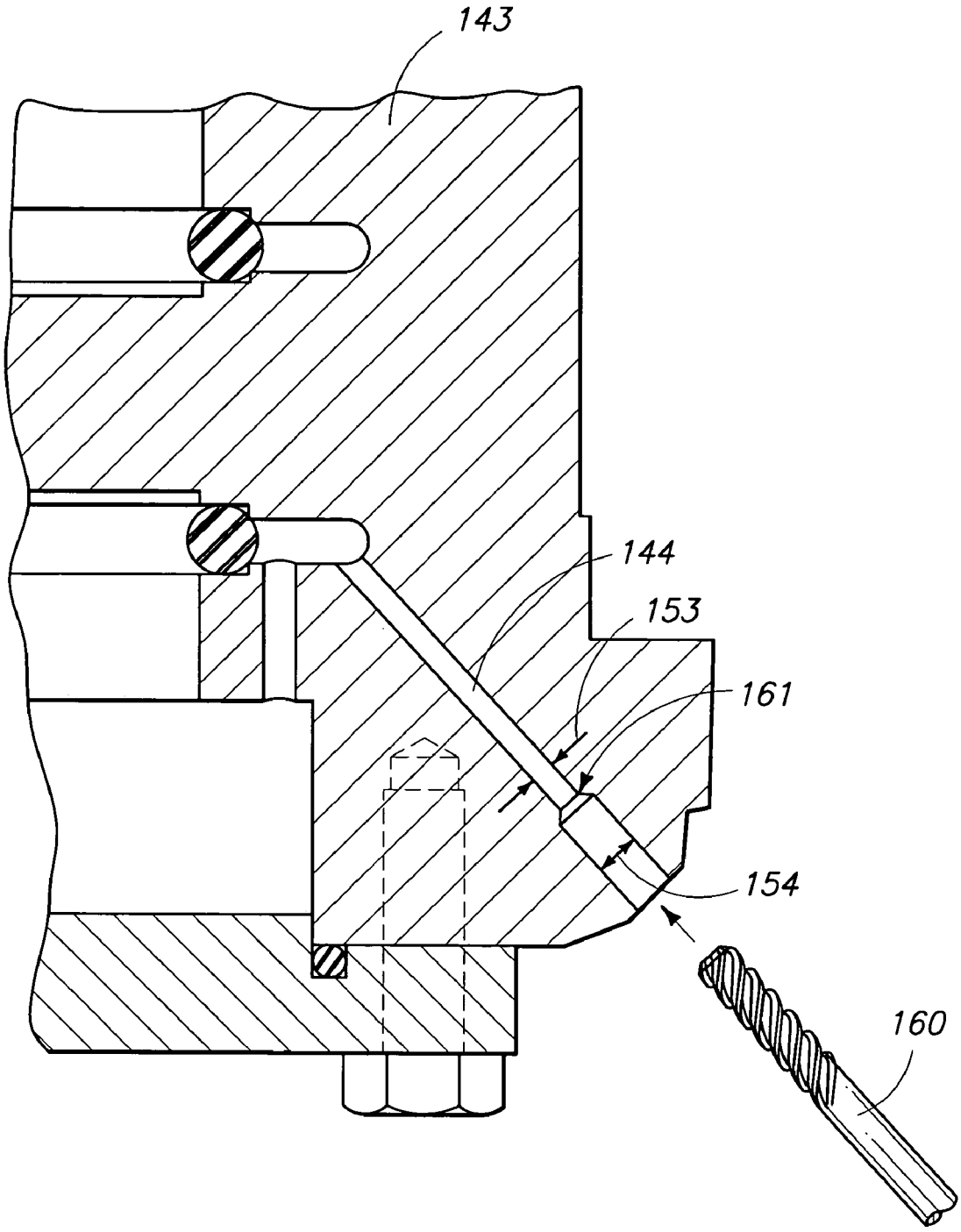
FIG. 7 is a part schematic, part cross-sectional view of a mold portion and illustrating the retrofitting of an existing coolant discharge orifice or aperture by drilling out the discharge end of the orifice, and thereby increasing its diameter at its discharge end.

FIG. 7 is a part schematic, part cross-sectional view of a mold showing the retrofitting of an existing coolant discharge aperture by drilling out the discharge end of the aperture with drill bit 160. Framework 143 has baffle portion 144 with diameter 153 and illustrates where the portion of the discharge aperture proximate the discharge or second end has been drilled with drill bit 160 to increase the cross-sectional area to diameter 154. The increased diameter results in increased cross-sectional area and the resulting jet or coolant discharged toward the castpart will consequently have a lower velocity. This will reduce the heat transfer at that portion of the castpart to which that flow is discharged, thereby reducing the effectiveness of the coolant discharged toward the castpart.

Figure 8:
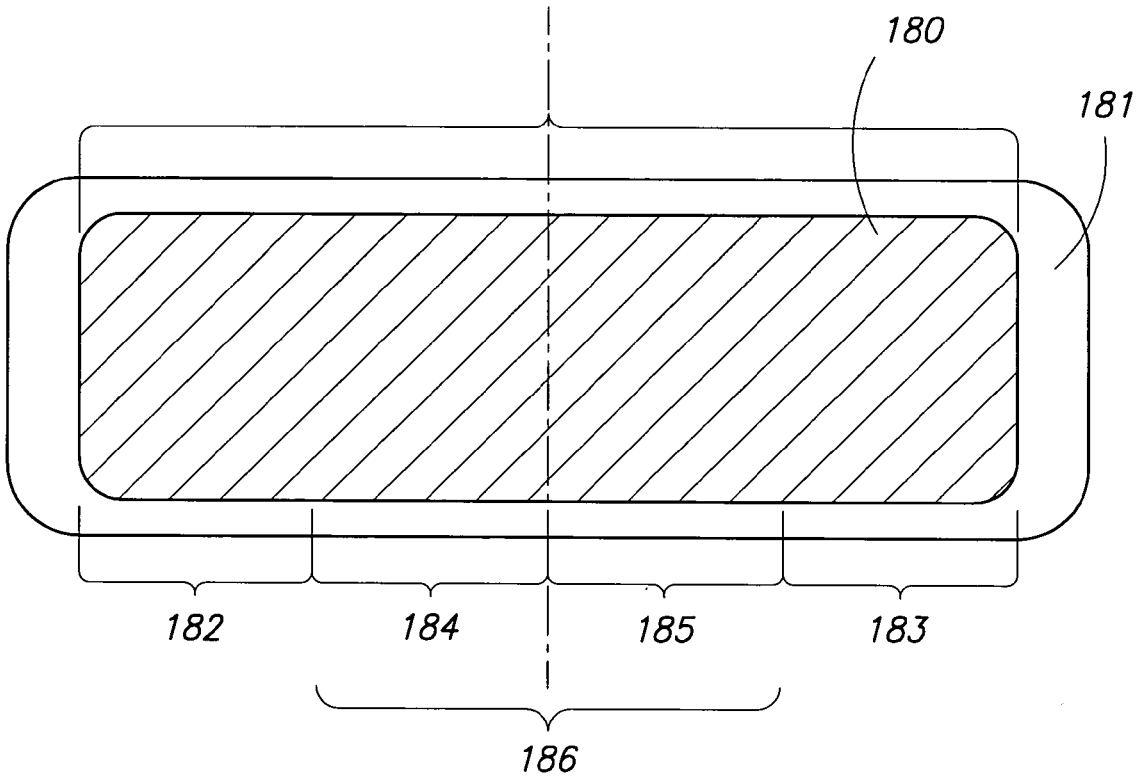
FIG. 8 is a top section view of an ingot castpart and its quadrant portions on its support platform.

FIG. 8 is a top sectional view of ingot shaped castpart 180 on support platform 181 wherein for definitional purposes, two quarter portions 182 and 183 are shown and two central portions 184 and 185 are shown. It will be appreciated that center surface portions 184 and 185 may alternatively be referred to as one center surface portion 186.

It is in the center surface portion of the castpart that it is desired to provide less cooling or less heat transfer to reduce butt curl in certain applications; that is less than the cooling provided to the quarter portions 182 and 183. If a higher temperature is maintained in the central portions 184 and 185, then the shrinkage during casting is less likely to occur, which reduces or minimizes butt curl.

It is known by those of ordinary skill in the art that the higher the steam stains in the central portion 184 and 185 relative to the quarter portions 182 and 183, the higher the temperature during casting due to film boiling considerations. It is preferred to achieve higher steam stains in the center surface portion(s) of the castpart for the reduction of butt curl.

Figure 9:
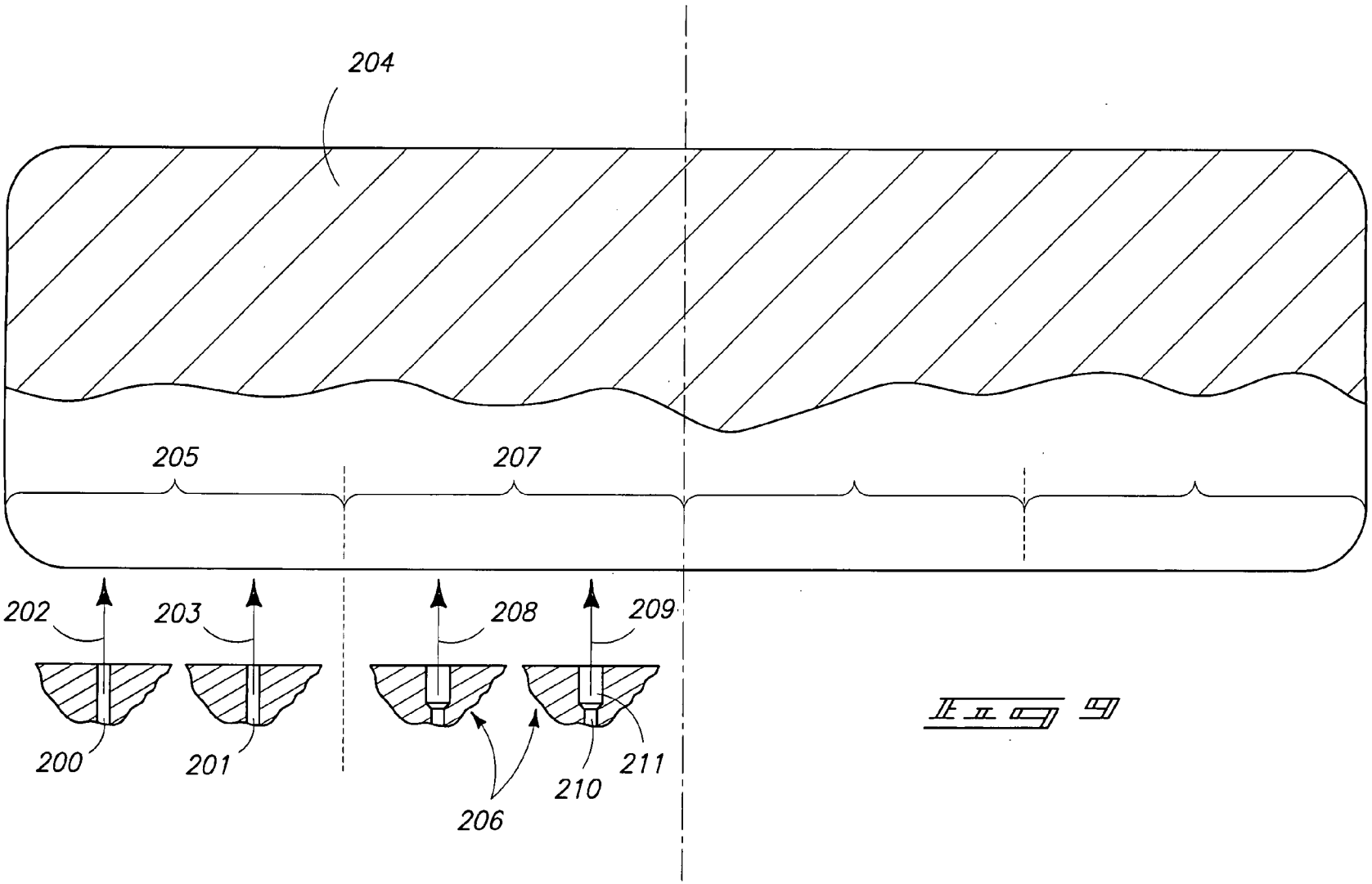
FIG. 9 is a schematic cross-sectional view of an ingot shaped castpart illustrating one embodiment of this invention.
Figure 11:
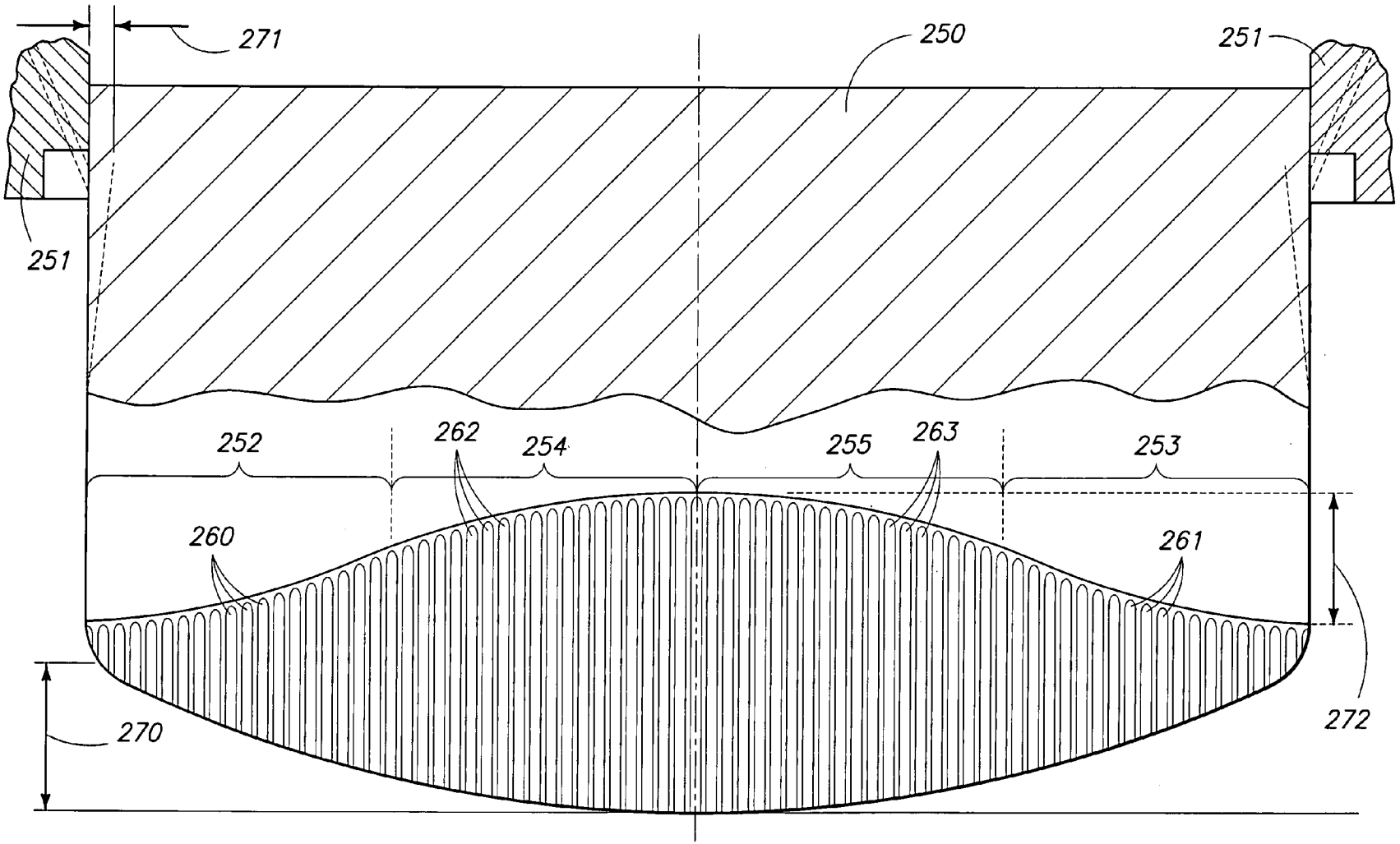
Figure 11:
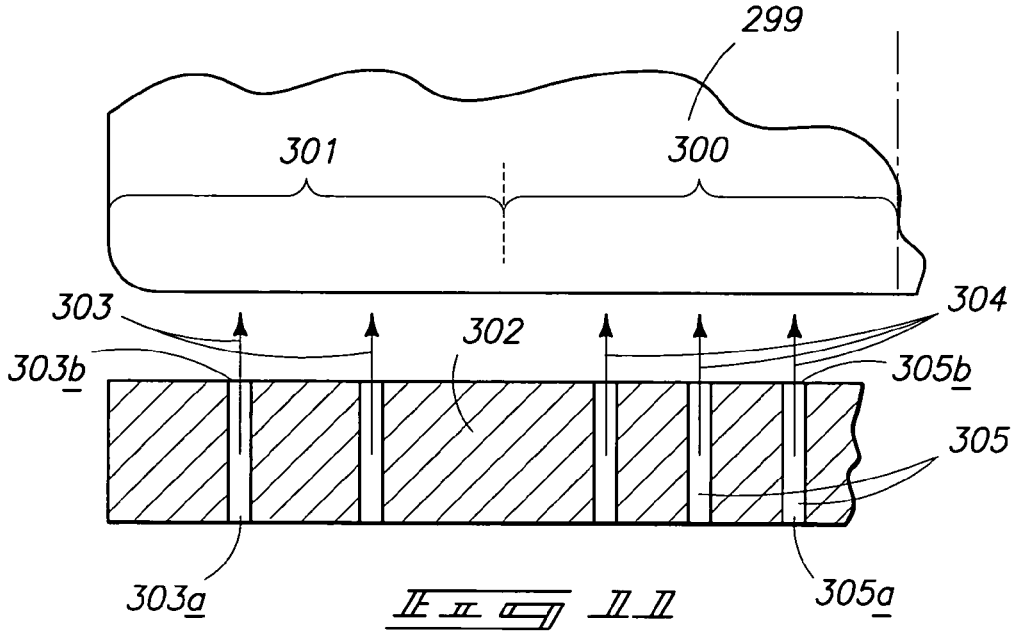

FIG. 9 is a schematic representation of an embodiment of this invention wherein typical coolant discharge apertures 200 and 201 provide coolant sprays 202 and 203 to castpart 204 in quarter portion 205. Coolant discharge aperture configurations 206 are provided to direct or discharge coolant to central portion 207 and provide discharge coolants 208 and 209 to castpart. The coolant discharge apertures or orifices have a smaller diameter section 210 and a larger diameter section 211. The smaller diameter section 210 may also be referred to as the baffle or baffle portion, and the larger section 211 may also be referred to as the spray hole portion. The effect of increasing the diameter affects the discharge coolant sprays 208 and 209 and serves to reduce the velocity thereof and/or reduce the flow rate.

FIG. 10 is an elevation view, part schematic and part cross-sectional, illustrating steam stains on an ingot castpart, as well as the effects of butt curl. The magnitude of the butt curl is exaggerated for illustration purpose in FIG. 10.

FIG. 10 illustrates castpart 250, mold framework 251, quarter portions 252 and 253, center surface portions 254 and 255 of castpart 250. Steam stains are shown in the lower portion of castpart 250, with quarter portions steam stains 260 being those within quarter portion 252, and steam stains 261 are within quarter portion 253. Center surface portion 254 has steam stains 262 and center surface portion 255 has steam stains 263.

It is evident from the drawing that the steam stains in the center surface portions 254 and 255 are higher than the steam stains 260 and 261 in quarter portions 252 and 253 respectively. The pattern of steam stains shown in FIG. 10 illustrate a more desired steam stain pattern to minimize butt curling. For purposes of illustration only, a butt curl distance 270 is shown in FIG. 10 and is exaggerated for the given steam stain pattern for illustration purposes. In cases where excessive butt curling occurs, the castpart 250 may shrink up in the upward portion near the mold as shown by an exemplary distance 271 and the gap created (between the mold and the side of the castpart) by said shrinkage may result in a breakout of molten metal and a failure condition for the molding process. If a breakout situation occurs, molten metal is released in an undesirable way and the casting process must be aborted.

Arrow 272 in FIG. 10 shows a differential in the height of steam stains in quarter portion 253 as compared to the highest steam stains in center surface portions 254 and 255. The representative steam stain pattern illustrated in FIG. 10 also indicates that higher temperatures were reached toward the center of the castpart or ingot as compared to the ends or sides which would fall within quarter portions 252 and 253.

Figure 11:
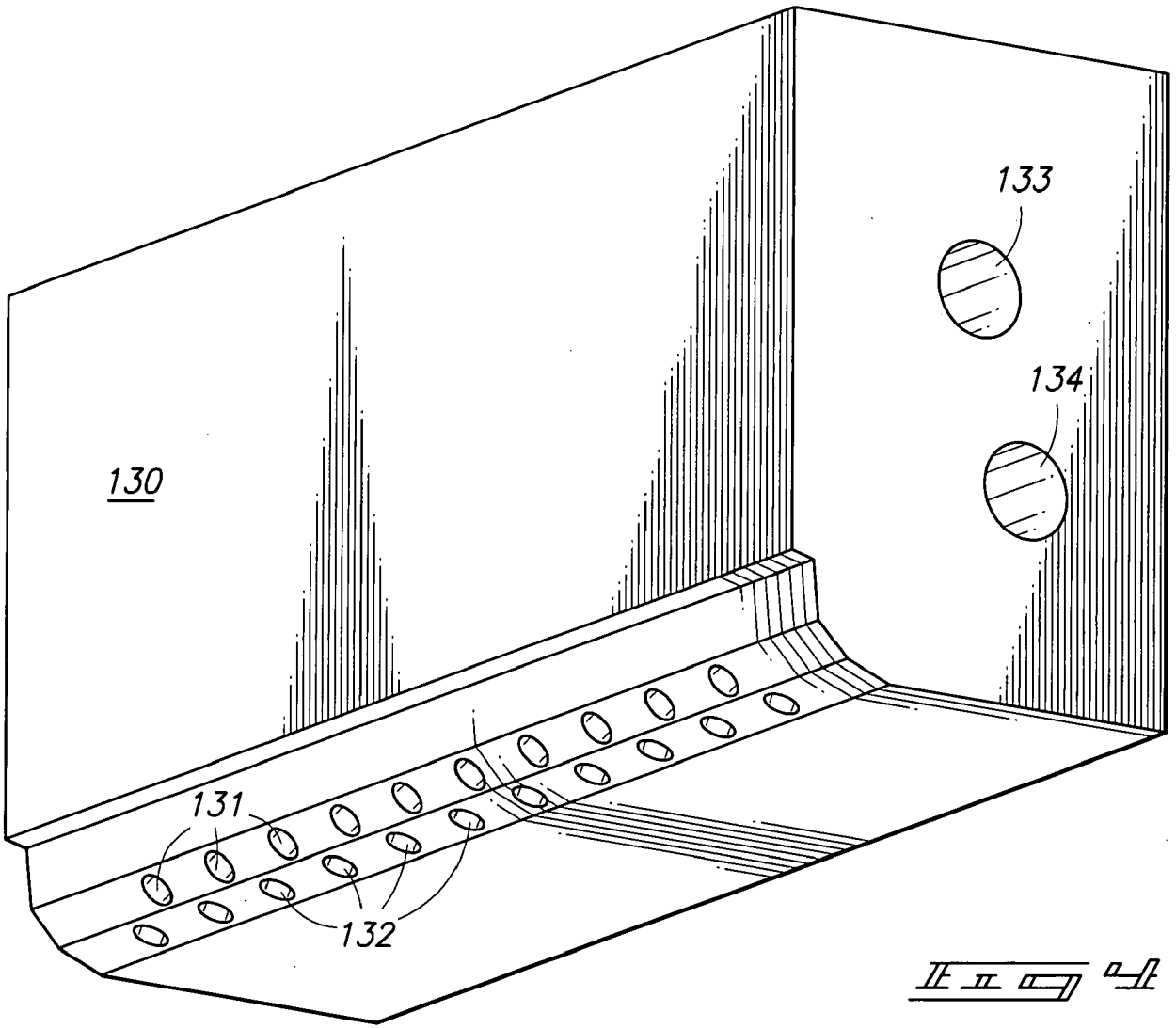
FIG. 11 is a schematic elevation view of another embodiment of this invention.

FIG. 11 shows a schematic elevation view of an embodiment of the invention in which only a baffle is used and for which internal configurations or alterations (not shown in FIG. 11) on the interior surface of the discharge aperture may be utilized to effect the velocity and/or flow, which consequently effects the heat transfer to the discharged coolant provided to center surface portion 300 and quarter portion 301. Baffle or framework 302 has coolant discharge orifices 303 directing or discharging coolant to the exterior surface of the castpart 299 on quarter portion 301, and discharging coolant 304 through coolant discharge apertures 305 to provide coolant to center surface portion 300 of castpart 299. FIG. 11 shows a schematic representation of one environment in which some embodiments of the invention may be utilized, without providing any detail thereof.

Figure 12:
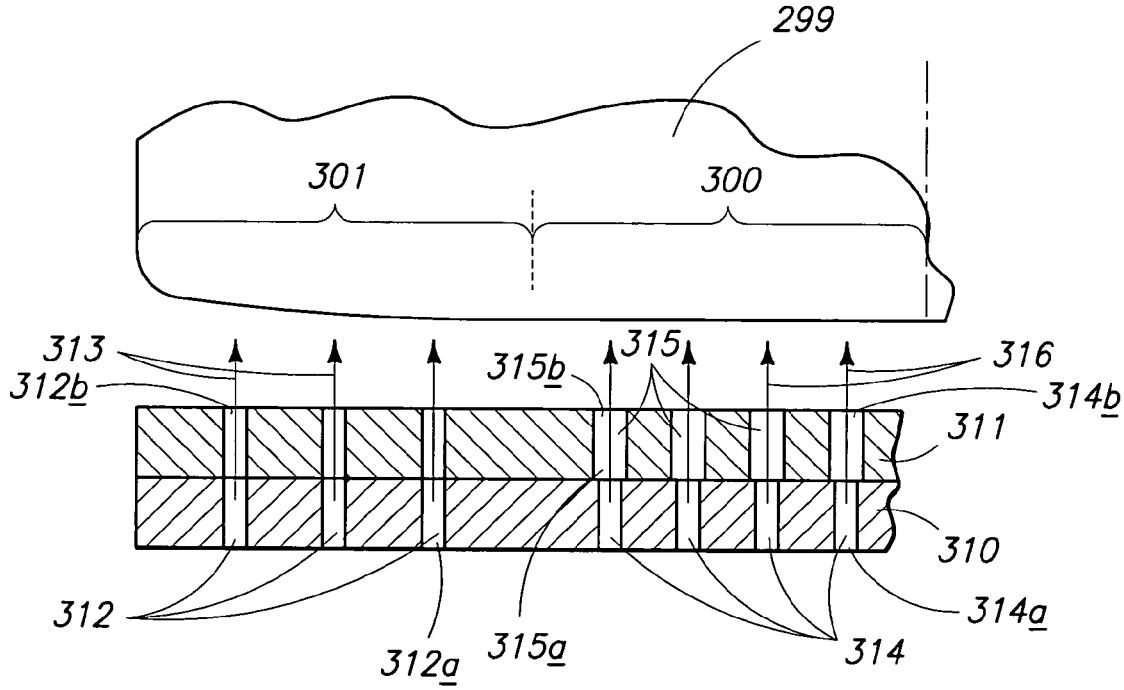
FIG. 12 is a schematic elevation view of an embodiment of this invention.

FIG. 12 is a schematic elevation view of yet another embodiment of the invention wherein the cooling system is configured to reduce the velocity of the coolant discharged toward the center surface portion 300 of the castpart 299. FIG. 12 illustrates castpart 299, quarter portion 301, center surface portion 300, baffle or framework 310 and spray hole 314 (may also be referred to as a framework or integral with the baffle framework). The orifices or coolant discharge apertures in framework 310 all have approximately the same cross-sectional areas and all provide approximately the same flow rate of coolant. Coolant discharge apertures 312 are therefore providing coolant sprays 313 to quarter portion 301 of castpart 299. Coolant discharge apertures 314 provide approximately the same flow rate of coolant to spray holes 315 in framework 311 and provide coolant discharge 316 toward castpart 299 in center surface portion 300.

The larger diameter spray holes 315 (which are also coolant discharge apertures) provide discharged coolant 316 at a lower velocity to center surface portion 300 of castpart 299, than the velocity of discharged coolant 313. This results in less heat transfer at the center surface portion 300 and therefore results in a higher temperature in the center surface portion 300 of castpart 299 during casting. The end effect is reduced butt curl and a more desirable castpart.

In an embodiment from FIG. 12 for example, all the cross-sectional areas (which may but need not be circular) of baffle portions 312 and 314 would be approximately the same, and separately, all the cross-sectional areas (which may but need not be circular) of spray hole portions 313 would be approximately the same, and separately, all the cross-sectional areas of spray hole portions 315 would be approximately the same as one another although a different cross-sectional area than spray hole portions 312.

Figure 13:
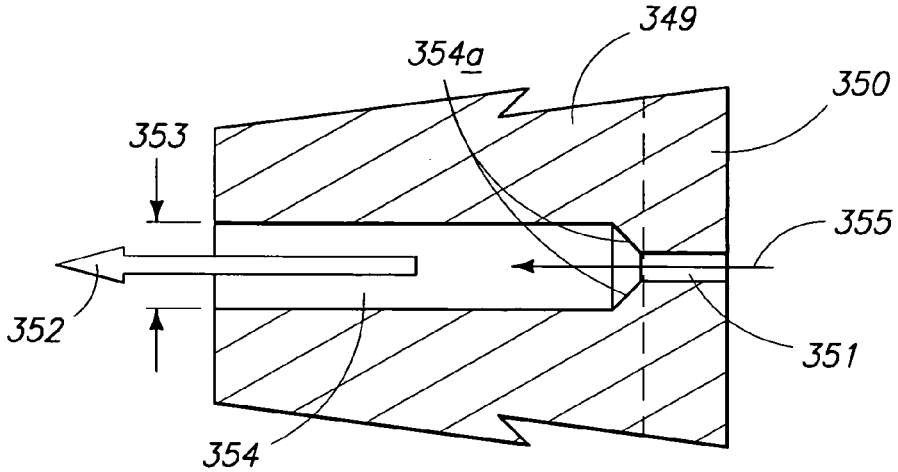
FIG. 13 is a cross-sectional schematic representation of a coolant discharge aperture configuration which may be utilized in an embodiment of this invention.

FIG. 13 is a schematic cross-section representation of a coolant discharge aperture configuration, which may be utilized in embodiments of this invention. FIG. 13 illustrates framework 349 with what may be referred to as a baffle portion 350 of framework 349, with baffle portion 351 and coolant 355 passing through baffle 351 and into spray hole 354. In this embodiment, a larger diameter portion 354 (of the coolant discharge aperture) has been drilled into framework 349 with angled ends 354*a*. The coolant passes through baffle portion 351 and into the larger diameter portion 354 and coolant 352 is discharged towards the castpart (not shown in this Figure). The diameter 353 of the spray hole portion of the coolant discharge aperture is larger than the diameter of the baffle portion. The larger diameter 353 results in a lower velocity than if diameter 353 were the same as the diameter for baffle portion 351.

It will be appreciated by those of ordinary skill in the art that reducing the velocity of the coolant 352 discharge toward the center surface portions of a castpart or ingot will reduce the heat transfer to the coolant discharged toward the castpart in that area, and thereby allows a better controlled predetermined temperature distribution across the castpart.

There are numerous potential embodiments for altering the velocity and/or the flow rate of the coolant discharged towards the castpart within the contemplation of this invention. Embodiments of this invention do however contemplate that the flow rate received through baffle portion 351 be the same for coolant discharge apertures which direct coolant towards the quarter portions and the center surface portion(s), for system control and other reasons.

Figure 14:
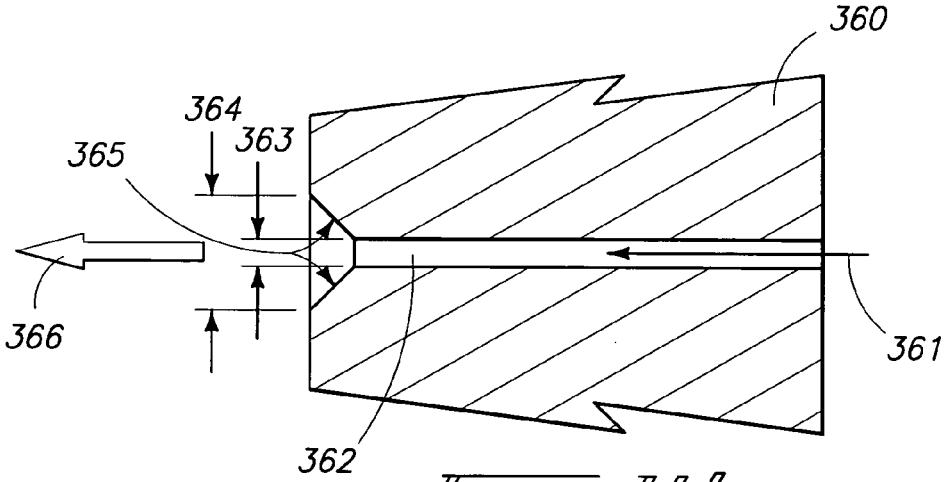
FIG. 14 is a cross-sectional schematic representation of a coolant discharge aperture configuration which may be utilized in embodiments of this invention.

FIG. 14 is a cross-sectional schematic representation of another embodiment of the invention wherein the baffle portion 362 in framework 360 is longer and the coolant discharge aperture is widened at area 365 proximate the discharge area. The diameter 363 of baffle portion 362 of the coolant discharge aperture is significantly smaller than the largest distance 364 (which may but need not be a diameter) across the coolant discharge aperture. The coolant 366 discharged towards a castpart is represented as shown.

Figure 15:
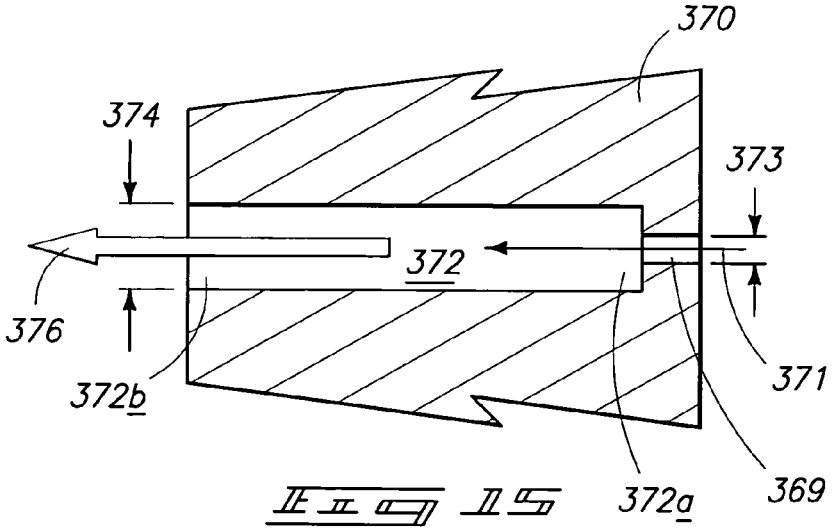
FIG. 15 is a cross-sectional schematic representation of a coolant discharge aperture configuration which may be utilized in embodiments of this invention.

FIG. 15 is a cross-sectional schematic representation of another embodiment of the invention similar to that shown in FIG. 13, only wherein the transition from the baffle portion 369 of the coolant discharge aperture, to the spray hole portion 372 is stepped, abrupt or an immediate transition, as shown in FIG. 15. The diameter 374 of the second end 372*b* is larger than the diameter 373 of baffle portion 369. A first end 372*a* of spray hole portion 372 receives coolant 371 from baffle portion 369, all within framework 370. Coolant 376 discharged towards castpart will have different flow characteristics due to the larger diameter 374 and will result in less heat transfer from the castpart to the coolant discharged to that portion of the castpart.

Figure 16:
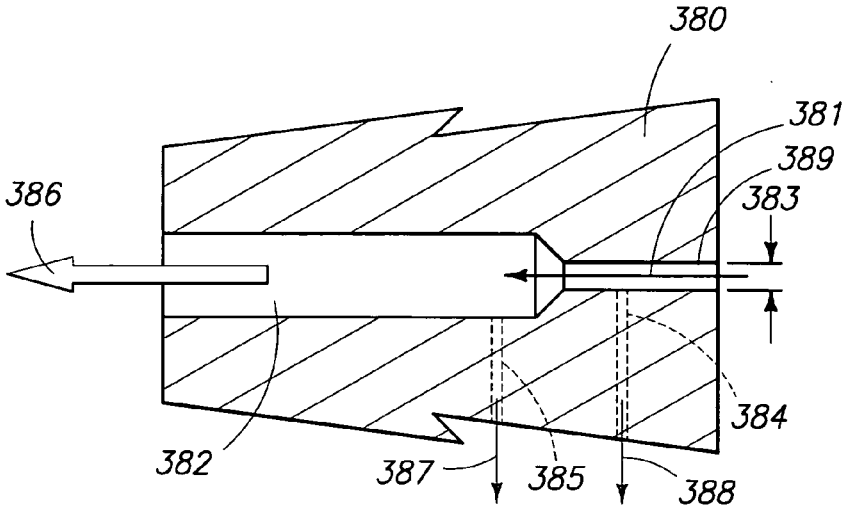
FIG. 16 is a cross-sectional schematic representation of a coolant discharge aperture configuration which may be utilized in embodiments of this invention.

FIG. 16 is a cross-sectional schematic representation of a coolant discharge aperture which may be utilized in embodiments of this invention, showing framework 380, spray hole portion 382 of coolant discharge aperture with coolant 381 flowing through baffle portion 389, which has a diameter 383. The end portion 382 of the coolant discharge aperture discharges coolant 386 toward the castpart.

In this embodiment, a diversion aperture 384 is provided away from baffle portion 389 to divert flow of coolant and reduce the cooling capacity of coolant 386 discharged towards the castpart, and the heat transfer from the castpart to the coolant in that portion of the castpart. The diverted coolant 388 can then be routed to other locations and not towards the castpart. This invention further contemplates that a diversion aperture such as diversion aperture 385 may divert coolant 387 from the spray hole portion or the discharge end portion of the coolant discharge aperture as shown in FIG. 16. This may be done in combination with the discharge aperture 384 as shown in the baffle portion or solely provided in the spray hole 382 portion of the coolant discharge aperture.

Figure 17:
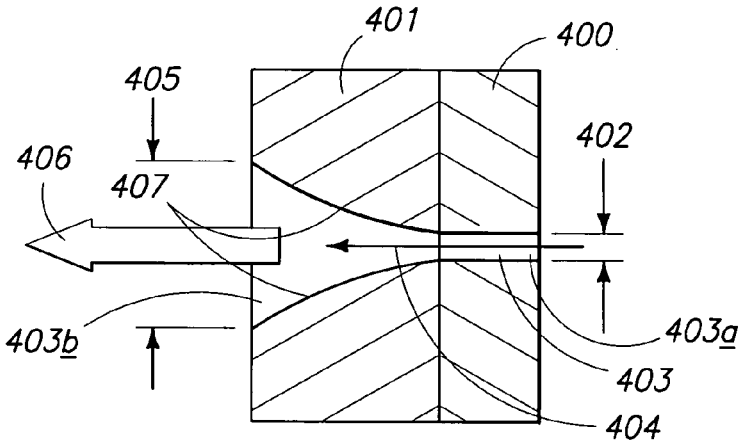
FIG. 17 is a cross-sectional schematic representation of a coolant discharge aperture configuration which may be utilized in embodiments of this invention.

FIG. 17 is a cross-sectional schematic representation of the coolant discharge aperture which may be utilized in embodiments of this invention, showing a separate baffle 400 to framework 401 with a trumpeted or outwardly opening curved discharge opening 407. The baffle portion 403 of the coolant discharge aperture receives fluid 404 and delivers it to the spray hole portion 407 of the coolant discharge aperture. The spray hole portion 407 has an increasing cross-sectional area and it can be calculated that the velocity of the coolant 406 discharged towards the castpart will thereby be reduced, and there may be some additional flow diverted to further reduce the heat transfer to the coolant 406. The largest distance 405 across the spray hole portion 407 of the coolant discharge aperture 405 is shown and may be a diameter or merely a distance. A first end 403*a* of the entire coolant discharge aperture is shown, as is a second end 403*b* or discharge end of the coolant discharge aperture (in the spray hole portion 407) of the coolant discharge aperture.

Figure 18:
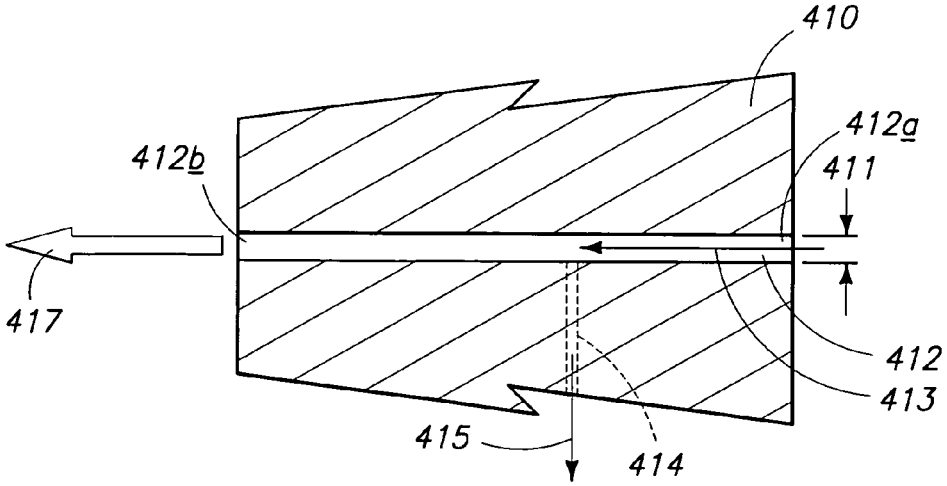
FIG. 18 is a cross-sectional schematic representation of a coolant discharge aperture configuration which may be utilized in embodiments of this invention.

FIG. 18 is a cross-sectional schematic representation of a coolant discharge aperture configuration which may be utilized in embodiments of this invention, showing a constant or uniform diameter coolant discharge aperture 412 with a first end 412*a*, second end 412*b* and which discharges coolant 417 toward the castpart to be cooled. Framework 410 further includes diversion aperture 414 which diverts coolant flow 415 to reduce the heat transfer to coolant 417 discharged towards the castpart. Again, this would preferably be used in one or more of the center surface portions of the framework so that reduced cooling capacity through a reduced flow rate or through a reduced velocity to the castpart is achieved.

Figure 19:
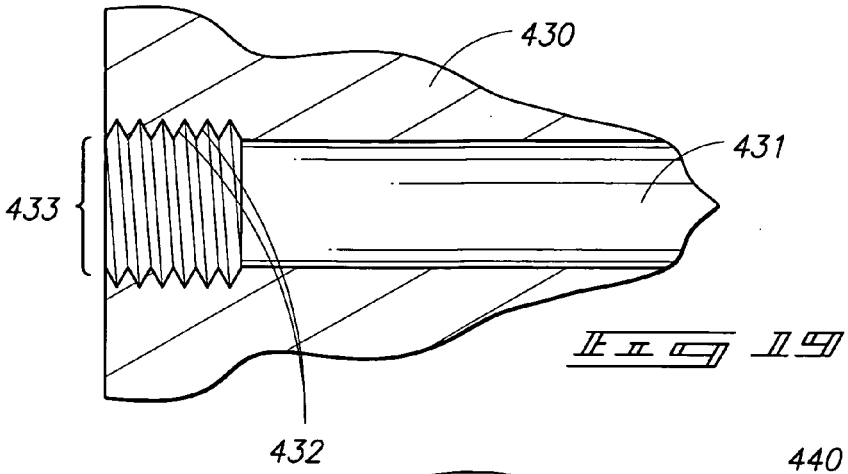
FIG. 19 is a detail schematic of another embodiment of the invention wherein traditional screw threads are used in the discharge aperture to effect the flow and/or velocity of the coolant.

FIG. 19 is a detail schematic of another embodiment of the invention to attenuate or divert flow or reduce velocity of coolant discharged toward the castpart. FIG. 19 shows framework 430, coolant discharge aperture 431 with an altered portion shown as internal threads 432 at the second end or discharge 433 of coolant discharge aperture 431. Alterations in flow rate and/or velocity may be utilized to alter cooling at that portion of the castpart.

Figure 20:
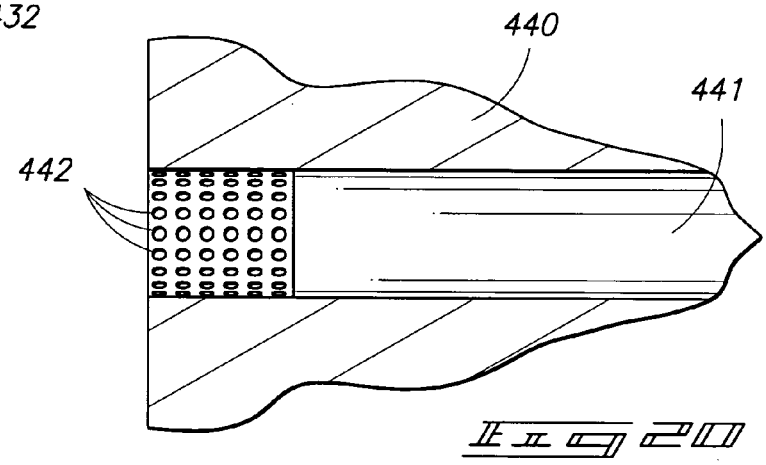
FIG. 20 is a detail schematic of another embodiment of the invention wherein detents in the surface of the aperture are used in the discharge aperture to effect the flow and/or velocity of the coolant.

FIG. 20 is a detail schematic of another embodiment of the invention where detents in the internal surface of the aperture are utilized to alter the flow rate and/or velocity characteristics of the coolant discharged towards the castpart. FIG. 20 shows framework 440, coolant discharge aperture 441 and detents 442 imparted on the internal surface of the aperture towards the discharge end.

Figure 21:
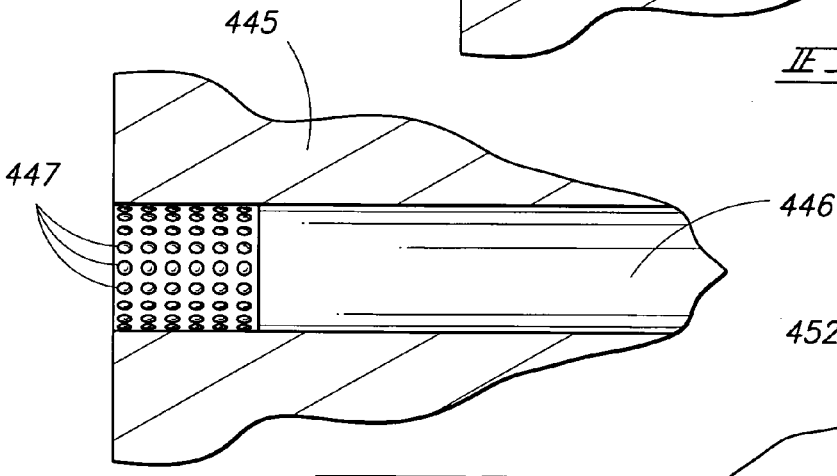
FIG. 21 is a detail schematic of another embodiment of the invention wherein protrusions in the surface of the aperture are used in the discharge aperture to effect the flow and/or velocity of the coolant.

FIG. 21 is a detail schematic of another embodiment of the invention wherein protrusions 447 are placed on the internal surface of the coolant discharge aperture 446 in framework 445 to alter the flow rate and/or velocity characteristics of coolant discharged towards the castpart.

Figure 22:
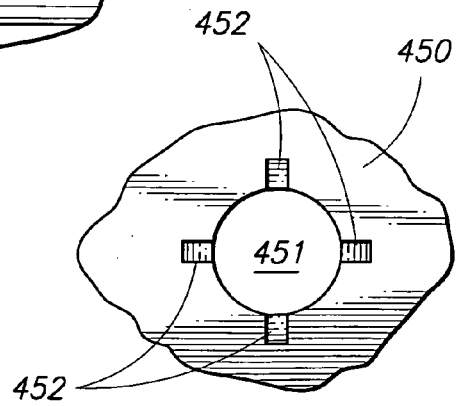
FIG. 22 is a schematic end view of another embodiment of an invention where angled slots are located in the framework at the discharge end of the discharge aperture to reduce discharge coolant flow and/or discharge coolant velocity.

FIG. 22 is a schematic end view of another embodiment of the invention where angled slots 452 are located or cut into framework 450 to alter the flow rate, flow and/or velocity characteristics of coolant discharged from coolant discharge aperture 451 toward the castpart. It will also be appreciated by those of ordinary skill in the art that when the term aperture is used herein relative to a coolant aperture discharging coolant toward a castpart, the discharge aperture may be any shape or configuration, including circular, elliptical, slot shaped and any other desired shape, all within the contemplation of this invention.

Figure 23:
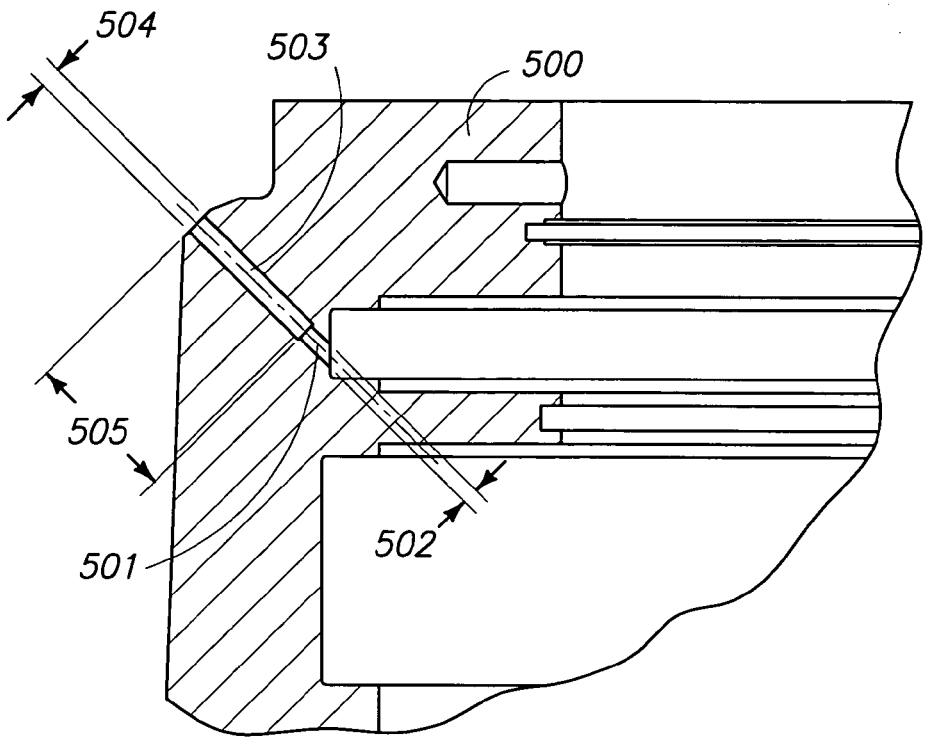
FIG. 23 is a cross-sectional view of a framework with another embodiment of the invention therein.

FIG. 23 is a cross-sectional view of a framework which may be utilized in embodiments of this invention. FIG. 23 shows framework 500 with baffle portion 501 and spray hole portion 503 of the coolant discharge aperture. The baffle portion 501 has a generally circular cross section with diameter 502, and spray hole portion 503 has a generally circular cross section with diameter 504 and with length 505. It is believed that the length of the spray hole portion 503 in this embodiment or application should be at least ten times the diameter, although no particular dimensions or ratios are necessary to practice this invention. Exemplary measurements for the embodiment shown in FIG. 23 are: diameter 504 equals 0.166 inches; length 505 equals 1.172 inches; diameter 502 equals 0.125 inches and the length of baffle portion 501 equals 0.20 inches. Again no specific or particular dimensions or ratios are required to practice this invention.

FIG. 24 is a cross-sectional view of a framework which may be utilized in embodiments of this invention. FIG. 24 shows framework 520 with baffle portion 521 and spray hole portion 523 of the coolant discharge aperture. The baffle portion 521 has a generally circular cross section with diameter 522 and length 519, and spray hole portion 523 has a generally circular cross section with diameter 524 and with length 525. It is believed that the length of the spray hole portion 523 in this embodiment or application should be at least ten times the diameter, although no particular dimensions or ratios are necessary to practice this invention. Exemplary measurements for the embodiment shown in FIG. 23 are: diameter 524 equals 0.156 inches; length 525 equals 1.491 inches; diameter 522 equals 0.109 inches and the length 519 of baffle portion 521 equals 0.60 inches. Again no specific or particular dimensions or ratios are required to practice this invention.

In one embodiment which generated the data presented later herein, in a secondary jet such as shown in FIG. 24, diameter 524 was 0.156 inches in a first fractional portion and 0.140 inches in a second fractional portion (where less heat transfer was desired), with diameter 522 remaining the same at 0.109 inches. This produced a desired steam stain and reduced butt curl.

The emphasis of affecting the steam stains and temperature distribution is across what is generally referred to as the rolling face of the ingot, which is the surface where the later rolling of the ingot will be focused. It should however be noted that this invention is not limited to application to any one surface of a castpart, but instead can be applied to ends, faces or any other, all within the contemplation of this invention. FIG. 24 shows the invention applied to the secondary coolant discharge aperture 523, which is the preferred aperture to apply the invention to and which is generally on during the start of the casting process.

Figure 25:
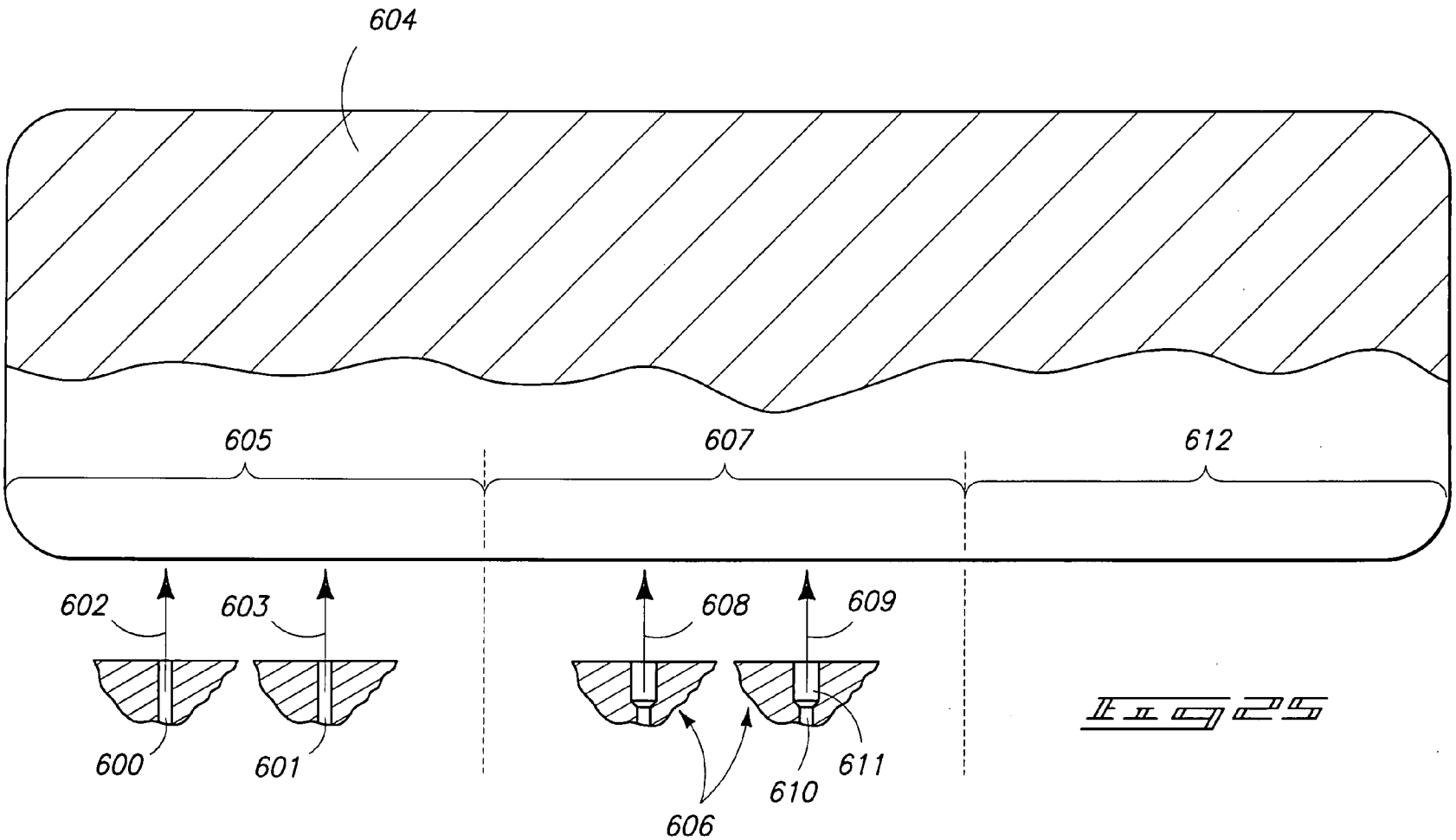
FIG. 25 is a schematic cross-sectional view of an ingot shaped castpart illustrating one embodiment of this invention.

FIG. 25 is a schematic cross-sectional view of an ingot shaped castpart illustrating another embodiment of this invention wherein the castpart is divided into thirds instead of quarters. This invention contemplates any fractional portions. FIG. 25 illustrates an embodiment of this invention wherein typical coolant discharge apertures 600 and 601 provide coolant sprays 602 and 603 to castpart 604 in fractional surface portion 605 (which is a one-third fractional surface portion). Coolant discharge aperture configurations 606 are provided to direct or discharge coolant to central portion 607 and provide discharge coolants 608 and 609 to castpart. The coolant discharge apertures or orifices have a smaller diameter section 610 and a larger diameter section 611. The smaller diameter section 610 may also be referred to as the baffle or baffle portion, and the larger section 611 may also be referred to as the spray hole portion. The effect of increasing the diameter affects the discharge coolant sprays 608 and 609 and serves to reduce the velocity thereof and/or reduce the flow rate.

Figure 26:
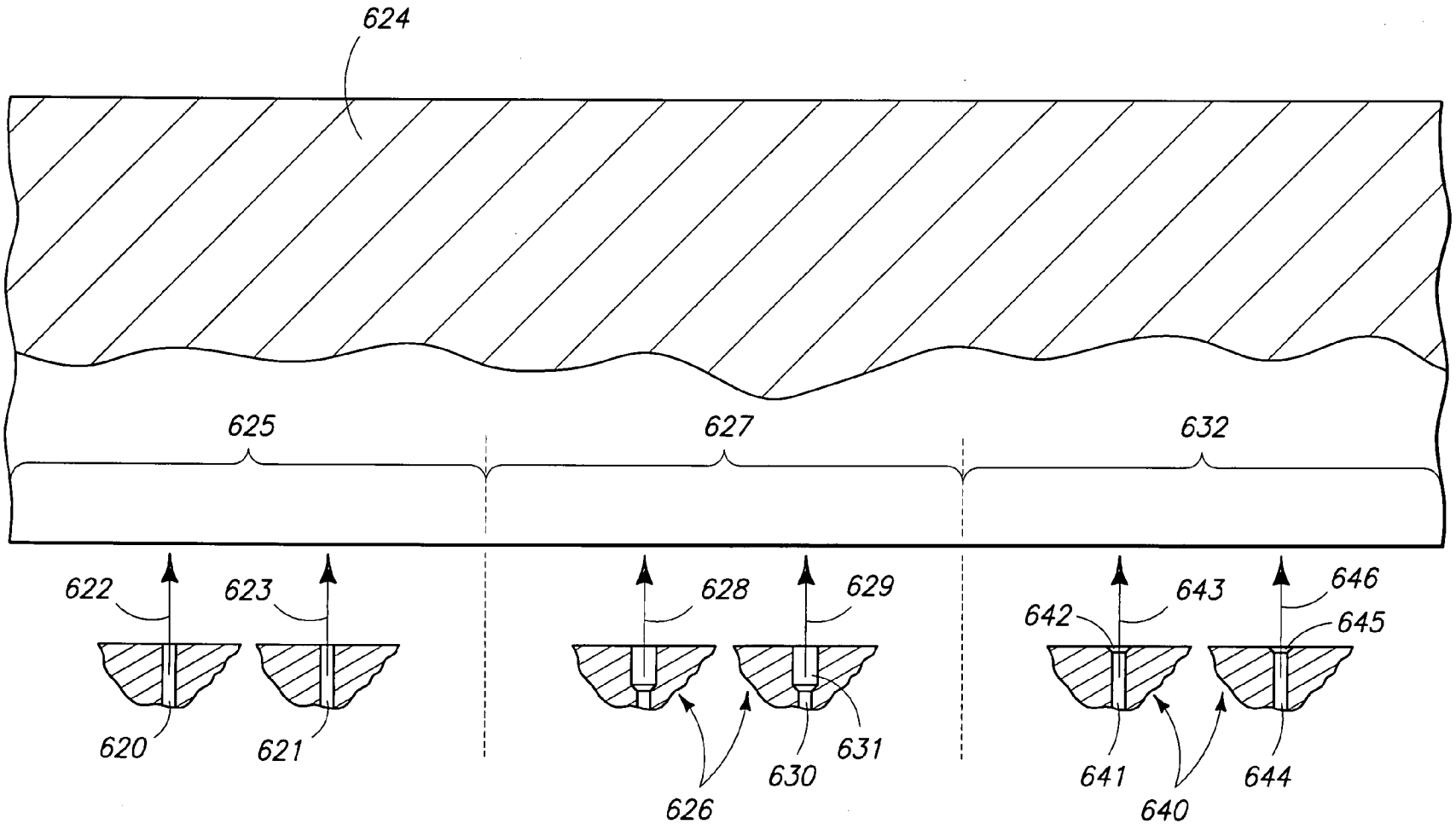
FIG. 26 is a schematic cross-sectional view of a portion of a castpart, illustrating an embodiment of this invention utilized thereon.
Figure 11:
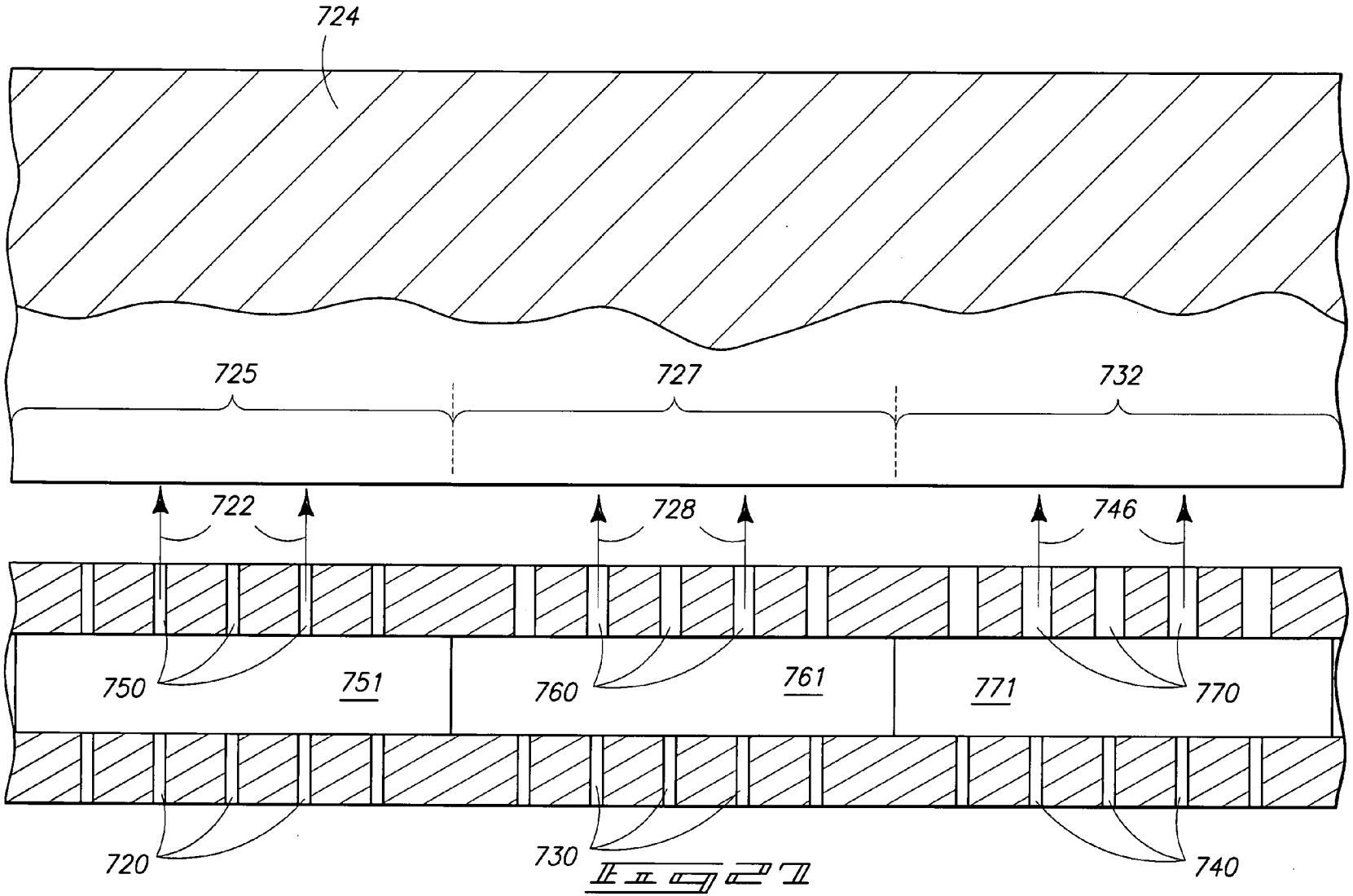

FIG. 26 is a schematic cross-sectional view of a portion of any shaped castpart, illustrating an embodiment of this invention utilized thereon. FIG. 26 illustrates how this invention can be used anywhere around the perimeter of a mold or around a cooling framework, and on a castpart of any shape. FIG. 26 shows a localized change in the cooling of a castpart and a repeatable pattern. For instance this invention at its very basic level may be used at a location, or it may be repeated around the perimeter or periphery of any mold cavity no matter the shape. It may also be applied to or used on any surface whether at an end portion of a castpart, a center portion or any other location or surface. For example the invention may be utilized to apply different cooling at several different locations around a cooling framework, thereby applying different coolant discharges to several different parts of a castpart.

FIG. 26 illustrates an embodiment of this invention wherein typical coolant discharge apertures 620 and 621 provide coolant sprays 622 and 623 to castpart 624 in first fractional surface portion 625. Coolant discharge aperture configurations 626 are provided to direct or discharge coolant to a second fractional surface portion 627 and provide discharge coolants 608 and 609 to castpart. The coolant discharge apertures or orifices have a smaller diameter section 630 and a larger diameter section 631. The smaller diameter section 630 may also be referred to as the baffle or baffle portion, and the larger section 631 may also be referred to as the spray hole portion. The effect of increasing the diameter affects the discharge coolant sprays 628 and 629 and serves to reduce the velocity thereof and/or reduce the flow rate.

FIG. 26 also shows another embodiment applying cooling to yet another fractional surface portion, in this embodiment the third fractional surface portion 232, utilizing coolant discharge aperture configurations 640. The coolant discharge aperture configurations 640 include a plurality of coolant discharge apertures 641 and 644 (which are the same cross-sectional area and therefore provide the approximate same coolant flow rate). The coolant discharge apertures shown directed to the other fractional surface portions likewise have the same approximate cross-sectional area and therefore provide the approximate same coolant flow rate. The discharge apertures 641 and 644 also have an increased diameter 645 at the second end or discharge end. Coolant 643 and 646 are discharged toward a third fractional surface portion 632 on castpart 624. Although only two coolant discharge apertures are shown for each fractional surface portion, in practice there would typically be many more in each area, as will be appreciated by those of ordinary skill in the art.

FIG. 26 illustrates how this invention may uniquely be applied in any given fractional surface portion of a mold and that there may be several different fractional surface portions, each with its own predetermined spray characteristics. For instance, one mold may have two, three, four, five or more fractional surface portions, each with its own predetermined spray characteristics, all within the scope of this invention.

FIG. 27 illustrates another embodiment of the invention, only applied in a different framework. In this type of framework, the baffles are all the same cross-sectional area so that the flow through each is the same. Although the invention is not limited to a particular shape of baffle, the preferred in some embodiments is a circular cross section. The coolant reservoirs are separate from one another for one size or configuration of spray holes, and it is preferred that one reservoir only provide coolant to spray holes of a given cross-sectional area or flow rate.

FIG. 27 shows castpart 724 with first fractional surface portion 725, second fractional surface portion 727, and third fractional surface portion 732. There may be more but only three are shown for illustration purposes. A first plurality of baffles 720 are each the same approximate cross-sectional area and are configured to receive coolant at a first end and to provide the coolant into first reservoir 751. First reservoir 751 is in fluid communication and provides coolant to a first plurality of spray holes 750, which are each the same cross-sectional area and/or allow the passage of coolant at the same flow rate through each. Coolant 722 is discharged from the first plurality of spray holes 750 toward castpart 724 at a first fractional surface portion 725. A second plurality of baffles 730 are each the same approximate cross-sectional area as each other and as the first plurality of baffles 720, and are configured to receive coolant at a first end and to provide the coolant into second reservoir 761. Fluid cannot pass between the first reservoir 751 and the second reservoir 761, or between the second reservoir 761 and the third reservoir 771.

Second reservoir 761 is in fluid communication and provides coolant to the second plurality of spray holes 760, which are each the same cross-sectional area and/or allow the passage of coolant at the same flow rate through each in the second plurality. However the cross-sectional area of the second plurality of spray holes 760 is different than the cross-sectional area of the first plurality of spray holes 750. Similarly, the cross-sectional area of the third plurality of spray holes 770 is different than the cross-sectional area of the first plurality of spray holes 750 and also different from the cross-sectional area of the second plurality of spray holes 760. Coolant 728 is discharged from the second plurality of spray holes 760 toward castpart 724 at a second fractional surface portion 727.

Third reservoir 771 is in fluid communication and provides coolant to the third plurality of spray holes 770, which are each the same cross-sectional area and/or allow the passage of coolant at the same flow rate through each in the third plurality. Coolant 746 is discharged from the third plurality of spray holes 770 toward castpart 724 at a third fractional surface portion 732.

Some embodiments of this invention contemplate that the coolant discharges toward different fractional surface portions of the castpart be at different velocities, and this may apply for instance in FIG. 26 to first coolant discharges 622 and 623 versus second coolant discharges 628 and 629 versus third coolant discharges 643 and 646. That is to say that third coolant discharges 643 and 646 would be the same approximate velocity, a third discharge velocity, which would be different than the second discharge velocity of second coolant discharges 628 and 629, which in turn may be different than the first discharge velocity of first coolant discharges 622 and 623.

This invention contemplates that embodiments of systems utilizing this invention may include fractional portions of spray hole configurations to correspond to fractional surface portions on castparts all around molds of any and all shapes, to customize the heat transfer for whatever effects are desired.

This invention may also be applied to numerous different types of coolant frameworks. For instance many such frameworks include a plurality of baffle apertures, a common reservoir or plenum into which coolant flows from the baffle apertures, and a plurality of spray hole apertures downstream from the reservoir. Embodiments of this invention may easily be applied to this configuration so long as one intermediate reservoir only provided coolant to spray holes with the same diameter or same cross sectional area.

For some of the velocity determinations, they are calculated or estimated based on known formulas for calculating velocity through a cylinder (in the embodiments which utilize a cylinder for the baffle portion and another larger cylinder for the spray hole portion of the coolant discharge apertures.

For instance, to calculate that the velocity decreases if the volumetric flow rate stays the same, the following basic equation for flow through a cylinder may be utilized:

$$V=v*\pi*R^2=\pi(\Delta P/L+\rho g\cos\theta)*R^4/8\eta$$

Legend:

0.140 in diameter=0.07 in radius=0.0058 ft 0.156 in diameter=0.78 in radius=0.0065 ft 0.00022 $ft^3$/sec (per spray hole)=0.00167 gal./sec (per spray hole)=0.1 gpm (per spray hole)=0.2 gpm/in of mold periphery (with coolant streams on 0.5 in spacings).

V=volumetric flow rate v=coolant stream velocity

R=pipe radius

P=pressure change

L=length of pipe

ρ=density of fluid g=specific gravity

η=viscosity of fluid

The following is an example calculation:

$$0.00022\ ft^3/sec.=v*3.1415*(0.0058\ ft)^2$$

$$v=(0.00022\ ft^3/sec.)/(3.1415*0.0000336\ ft^2)$$

$$v=2.08\ \text{ft/sec}$$

The following is another example calculation:

$$0.00022\ ft^3/sec.=v*3.1415*(0.0065\ \text{ft})^2$$

$$v=(0.00022\ ft^3/sec.)/(3.1415*0.00004225\ ft^2)$$

$$v=1.66\ \text{ft/sec.}$$

While the above equations are believed to be substantially accurate, in practice or in an application testing would need to be completed to verify its accuracy or room for error, depending on factors such as the length of the spray hole portion of the coolant discharge aperture.

It will also be appreciated by those of ordinary skill in the art that embodiments of this invention may and will be combined with new systems and/or retrofit to existing operating casting systems, all within the scope of this invention, as described with respect to FIGS. 6, 23 and/or 24.

The following tables illustrates steam stain profiles results that may be accomplished:

Steam Stain Profiles w/ Center Velocity Modification at various gpm/in Start Water Flows

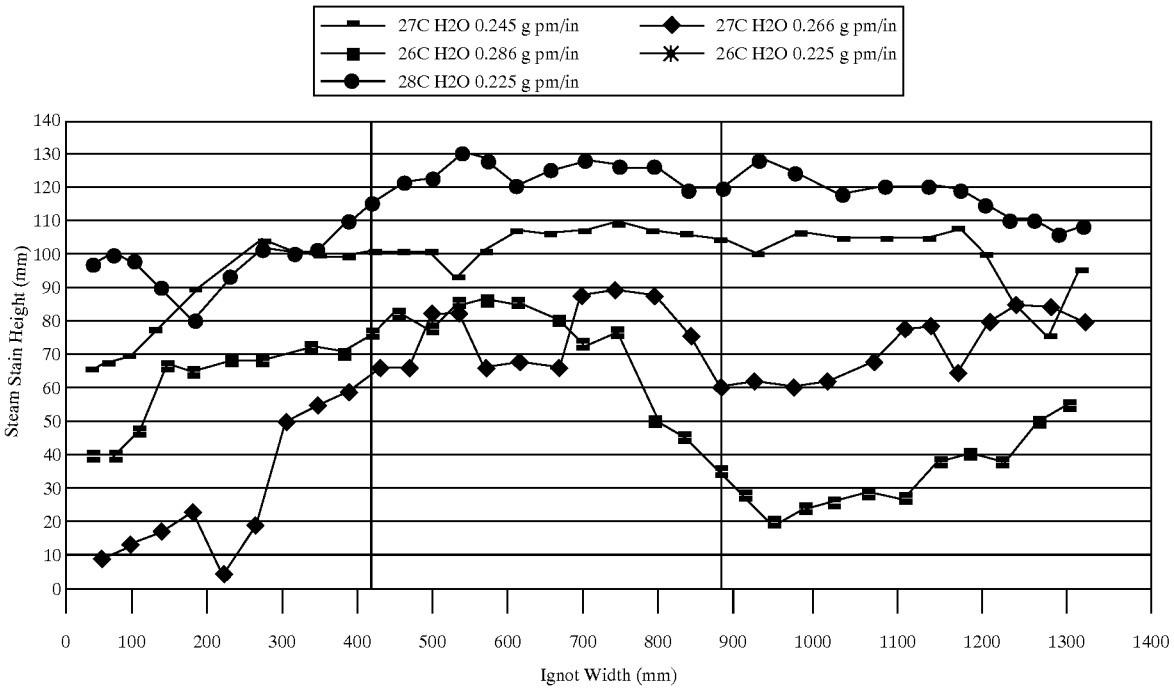

Steam Stain Measurements of 508×1524 Ingot of 5083 (Low Thermal Conductivity Alloy) after Coolant Stream Velocity Modification at Varying Water Flow Rates

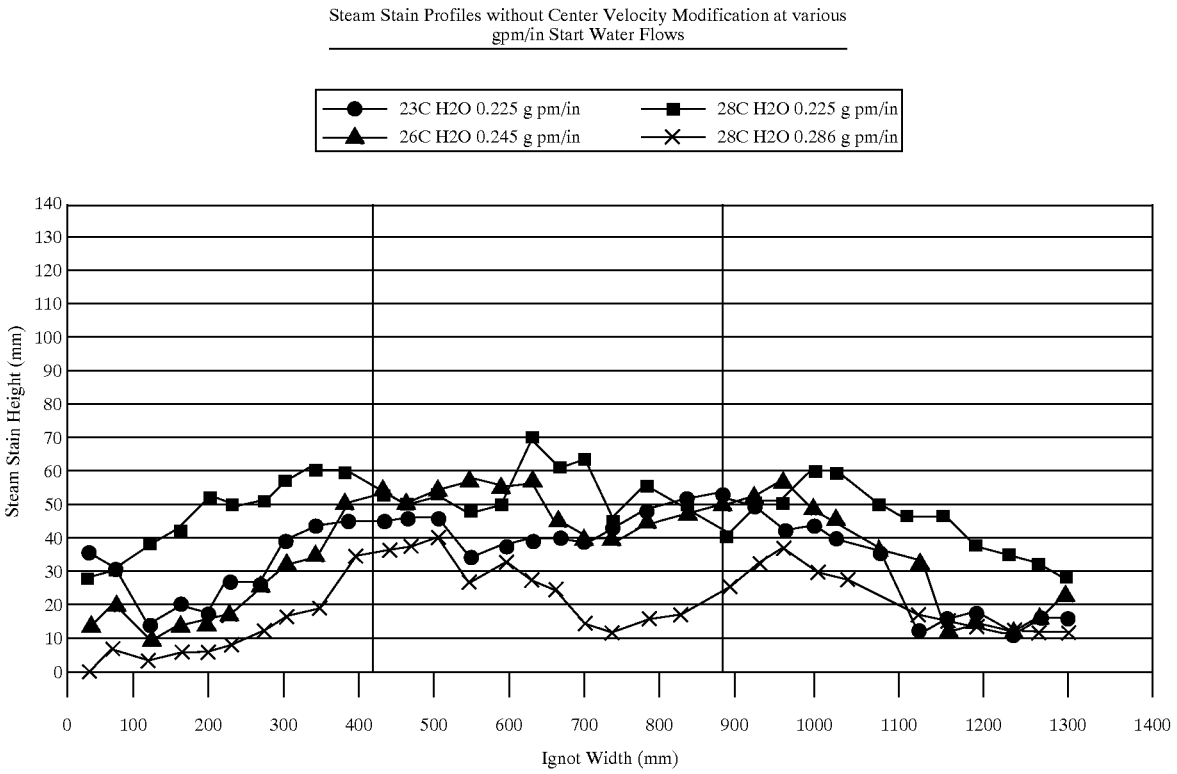

Steam Stain Measurements of 508×1 524 Ingots of 5083 before Coolant Stream Velocity Modification at Varying Water Flow Rates As can be seen in the plots of the steam stains in the two tables above, the steam stain nearly doubles in length after the velocity modification using the same local water flow rate and the steam stain is more heavily concentrated in the center of the ingot rather than the quarter points of the ingot. Both of these tendencies assist the start of an ingot cast by reducing the total butt curl. Butt curl measurements are shown in FIG. 9.

The following table shows measured butt curl for an ingot mold size of fifty-eight (58) millimeters by one thousand five hundred twenty four (1524) millimeters). As will be appreciated by those of ordinary skill in the art from the following butt curl measurements taken before and after the coolant discharge apertures were modified in accordance with this invention from a first fractional portion (a quarter portion) to a second fractional portion (a center portion in this example), the butt curl reduction was substantial.

Butt Curl with 5083

| water flow rate gpm/in | modified mm | unmodified mm |
|---|---|---|
| 0.225 | 8–17 | 34–40 |
| 0.245 | 13–18 | 40–47 |
| 0.286 | 29–35 | 48–57 |

The following test data table provides some of the data and calculations taken in limited testing and calculations:

(A) Measurement in center of 508 × 1524 mold with enlarged spray jet

| Test # | Spray Jet Diameter in | Set Point volumetric flow rate per length gpm/in | Bucket Check Time sec. | Measured volumetric flow rate gpm/in | Resultant calculated velocity ft/sec. |
|---|---|---|---|---|---|
| 1 | 0.156 | 0.245 | 61.1 | 0.245 | 0.06 |
| 2 | 0.156 | 0.245 | 60.1 | 0.250 | 2.1 |
| 3 | 0.156 | 0.245 | 62 | 0.242 | 2.03 |
| 4 | 0.156 | 0.245 | 60.2 | 0.249 | 2.09 |

(B) Measurements in quarter points of 508 × 1524 mold without enlarged spray jet.

| Test # | Spray Jet Diameter in | Set Point volumetric flow rate per length gpm/in | Bucket Check sec. | Measured volumetric flow gpm/in | Resultant calculated ft/sec. |
|---|---|---|---|---|---|
| 1 | 0.14 | 0.245 | 62.1 | 0.242 | 2.52 |
| 2 | 0.14 | 0.245 | 60.3 | 0.249 | 2.61 |
| 3 | 0.14 | 0.245 | 61.1 | 0.245 | 2.55 |
| 4 | 0.14 | 0.245 | 60.9 | 0.246 | 2.56 |

Same mold, same test = water flows (C) Measurements in center of 508 × 1524 mold with standard spray jets

| Test # | Spray Jet Diameter in | Set Point volumetric flow rate per length gpm/in | Bucket Check sec. | Measured volumetric flow gpm/in | Resultant calculated ft/sec. |
|---|---|---|---|---|---|
| 1 | 0.14 | 0.245 | 67.7 | 0.22 | 2.31 |
| 2 | 0.14 | 0.245 | 67 | 0.224 | 2.34 |
| 3 | 0.14 | 0.245 | 66.7 | 0.225 | 2.35 |
| 4 | 0.14 | 0.245 | 67.6 | 0.222 | 2.31 |

Different mold, lower water, higher velocity, less film

As will be appreciated by those of reasonable skill in the art, there are numerous embodiments to this invention, and variations of elements and components which may be used, all within the scope of this invention.

For example one embodiment of the invention may be a cooling system for use in a direct chilled casting mold system with a mold cavity, the mold system being configured for molding a metal castpart, the cooling system comprising: a cooling framework configured for location around a perimeter of a mold cavity, the cooling framework comprising: a first plurality of coolant discharge apertures configured at a first end to receive coolant at a first coolant flow rate, and configured at a second end to discharge a first discharge coolant flow at a first coolant discharge velocity toward a first fractional surface portion of a castpart being molded; a second plurality of coolant discharge apertures configured at a first end to receive coolant at a second coolant flow rate, and configured at a second end to discharge a second discharge coolant flow at a second coolant discharge velocity toward a second fractional surface portion of the castpart; wherein the first coolant flow rate is approximately equal to the second coolant flow rate; and further wherein the first coolant discharge velocity is less than the second coolant discharge velocity. It is also an embodiment wherein the first discharge coolant flow is less than the second discharge coolant flow.

The cooling system above may be solely comprised of water, or a mixture of water and another gaseous or liquid fluid. The embodiment of the cooling system recited in the preceding paragraph may be described: further wherein the first fractional surface portion is a center portion and the second fractional surface portion is a quarter portion; further wherein the first fractional surface portion is a center portion and the second fractional surface portion is a one-third portion; further wherein the first fractional surface portion and the second fractional surface portion are adjacent one another around the perimeter of a mold cavity; and/or further wherein the first fractional surface portion and the second fractional surface portion are spaced apart from one another around the perimeter of a mold cavity.

The cooling system recited above may be further described: further wherein the first coolant flow rate is within four percent of the second coolant flow rate; further wherein the first coolant flow rate is within eight percent of the second coolant flow rate; and/or further wherein the first coolant flow rate is within twelve percent of the second coolant flow rate.

In another embodiment, a cooling system is provided for use in a direct chilled casting mold system with a mold cavity, the mold system being configured for molding a metal castpart, the cooling system comprising: a cooling framework configured for location around a perimeter of a mold cavity, the cooling framework comprising: a first plurality of coolant discharge apertures configured at a first end to receive coolant at a first coolant flow rate, and configured at a second end to discharge a first discharge coolant flow at a first coolant discharge velocity toward a first fractional surface portion of a castpart being molded; a second plurality of coolant discharge apertures configured at a first end to receive coolant at a second coolant flow rate, and configured at a second end to discharge a second discharge coolant flow at a second coolant discharge velocity toward a second fractional surface portion of the castpart; wherein the first coolant flow rate is approximately equal to the second coolant flow rate; and wherein the first discharge flow rate is lower than the second discharge flow rate.

The cooling system above may be solely comprised of water, or a mixture of water and another gaseous or liquid fluid. The embodiment of the cooling system recited in the preceding paragraph may be described: further wherein the first fractional surface portion is a center portion and the second fractional surface portion is a quarter portion; further wherein the first fractional surface portion is a center portion and the second fractional surface portion is a one-third portion; further wherein the first fractional surface portion and the second fractional surface portion are adjacent one another around the perimeter of a mold cavity; and/or further wherein the first fractional surface portion and the second fractional surface portion are spaced apart from one another around the perimeter of a mold cavity.

The cooling system recited above may be further described: further wherein the first coolant flow rate is within four percent of the second coolant flow rate; further wherein the first coolant flow rate is within eight percent of the second coolant flow rate; and/or further wherein the first coolant flow rate is within twelve percent of the second coolant flow rate.

In another embodiment a cooling system may be provided for use in a direct chilled casting mold system with a mold cavity, the mold system being configured for molding a metal castpart, the cooling system comprising: a cooling framework configured for location around a perimeter of a mold cavity, the cooling framework comprising: a first-plurality of coolant discharge apertures configured at a first end to receive coolant at a first coolant flow rate, and configured at a second end to discharge a first discharge coolant flow at a first coolant discharge velocity toward a first fractional surface portion of a castpart being molded; a second plurality of coolant discharge apertures configured at a first end to receive coolant at a second coolant flow rate, and configured at a second end to discharge a second discharge coolant flow at a second coolant discharge velocity toward a second fractional surface portion of the castpart; wherein the first coolant flow rate is approximately equal to the second coolant flow rate; wherein the first discharge coolant flow creates a higher average steam stain on the first fractional surface portion than the second discharge coolant flow creates on the second fractional surface portion of the castpart.

The cooling system above may be solely comprised of water, or a mixture of water and another gaseous or liquid fluid. The embodiment of the cooling system recited in the preceding paragraph may be described: further wherein the first fractional surface portion is a center portion and the second fractional surface portion is a quarter portion; further wherein the first fractional surface portion is a center portion and the second fractional surface portion is a one-third portion; further wherein the first fractional surface portion and the second fractional surface portion are adjacent one another around the perimeter of a mold cavity; and/or further wherein the first fractional surface portion and the second fractional surface portion are spaced apart from one another around the perimeter of a mold cavity.

The cooling system recited above may be further described: further wherein the first coolant flow rate is within four percent of the second coolant flow rate; further wherein the first coolant flow rate is within eight percent of the second coolant flow rate; and/or further wherein the first coolant flow rate is within twelve percent of the second coolant flow rate.

In another embodiment of the invention, a cooling system may be provided for use in a direct chilled casting mold system with a mold cavity, the mold system being configured for molding a metal castpart, the cooling system comprising: a cooling framework configured for location around a perimeter of a mold cavity, the cooling framework comprising: a first plurality of coolant discharge apertures configured at a first end to receive coolant at a first coolant flow rate, and configured at a second end to discharge a first discharge coolant flow at a first coolant discharge velocity toward a first fractional surface portion of a castpart being molded; a second plurality of coolant discharge apertures configured at a first end to receive coolant at a second coolant flow rate, and configured at a second end to discharge a second discharge coolant flow at a second coolant discharge velocity toward a second fractional surface portion of the castpart; wherein the first coolant flow rate is approximately equal to the second coolant flow rate; further wherein the first plurality of coolant discharge apertures discharge the first discharge coolant and the second plurality of coolant discharge apertures discharge the second discharge coolant; and still further wherein heat transfer to the first discharge coolant flow is less than heat transfer to the second discharge coolant flow.

In yet another embodiment of the invention, a direct chilled casting mold is provided with a mold cavity configured for casting a metal castpart, and a cooling system, the cooling system comprising: a cooling framework configured for location around a perimeter of the mold cavity, the cooling framework comprising: a first plurality of coolant discharge apertures configured at a first end to receive coolant at a first coolant flow rate, and configured at a second end to discharge a first discharge coolant flow toward a center surface portion of a castpart being molded; a second plurality of coolant discharge apertures configured at a first end to receive coolant at a second coolant flow rate, and configured at a second end to discharge a second discharge coolant flow toward a fractional surface portion of the castpart; wherein the first coolant flow rate is approximately equal to the second coolant flow rate; further wherein the first plurality of coolant discharge apertures discharge the first discharge coolant and the second plurality of coolant discharge apertures discharge the second discharge coolant; and still further wherein the first discharge coolant flow is discharged relative to the second discharge coolant flow such that less heat is transferred to the first discharge coolant flow than to the second discharge coolant flow.

In a method embodiment of the invention may be provided for changing the cooling system on an existing direct chilled molten metal mold system which includes a plurality of coolant discharge apertures around a perimeter of a mold cavity, wherein each of the plurality of coolant discharge apertures have the same approximate cross-sectional input area, comprising: altering an internal surface of the coolant discharge aperture at a discharge end of the coolant discharge aperture.

Further methods from the one described in the preceding paragraph may be: wherein the internal surface of the coolant discharge aperture is altered by increasing its cross-sectional area at the discharge end; wherein the internal surface of the coolant discharge aperture is altered by drilling a larger diameter coolant discharge aperture at the discharge end; wherein the internal surface of the coolant discharge aperture is altered by increasing surface roughness of the internal surface at the discharge end; wherein the internal surface of the coolant discharge aperture is altered by imparting detents in the internal surface at the discharge end; and/or wherein the internal surface of the coolant discharge aperture is altered by imparting internal threads on the internal surface.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A cooling system for use in a direct chilled casting mold system with a mold cavity, the mold system being configured for molding a metal castpart, the cooling system comprising:

a cooling framework configured for location around a perimeter of a mold cavity, the cooling framework comprising:

a first plurality of coolant discharge apertures configured at a first end to receive coolant at a first coolant flow rate, and configured at a second end to discharge a first discharge coolant flow at a first coolant discharge velocity toward a first fractional surface portion of a castpart being molded;

a second plurality of coolant discharge apertures configured at a first end to receive coolant at a second coolant flow rate, and configured at a second end to discharge a second discharge coolant flow at a second coolant discharge velocity toward a second fractional surface portion of the castpart;

wherein the first coolant flow rate is approximately equal to the second coolant flow rate; and further wherein the first coolant discharge velocity is less than the second coolant discharge velocity.

2. A cooling system as recited in claim 1, and further wherein the coolant is water.

3. A cooling system as recited in claim 1, and further wherein the coolant comprises water.

4. A cooling system as recited in claim 1, and further wherein the coolant is a mixture of water and carbon dioxide.

5. A cooling system as recited in claim 1, and further wherein the first fractional surface portion is a center portion and the second fractional surface portion is a quarter portion.

6. A cooling system as recited in claim 1, and further wherein the first fractional surface portion is a center portion and the second fractional surface portion is a one-third portion.

7. A cooling system as recited in claim 1, and further wherein the first fractional surface portion and the second fractional surface portion are adjacent one another around the perimeter of a mold cavity.

8. A cooling system as recited in claim 1, and further wherein the first fractional surface portion and the second fractional surface portion are spaced apart from one another around the perimeter of a mold cavity.

9. A cooling system as recited in claim 1, and further wherein the casting mold system is configured to cast an ingot shaped castpart.

10. A cooling system as recited in claim 1, and further wherein the first coolant flow rate is within four percent of the second coolant flow rate.

11. A cooling system as recited in claim 1, and further wherein the first coolant flow rate is within eight percent of the second coolant flow rate.

12. A cooling system as recited in claim 1, and further wherein the first coolant flow rate is within twelve percent of the second coolant flow rate.

13. A cooling system as recited in claim 1, and further wherein heat transfer from the castpart to the first discharge coolant flow is less than heat transfer to the second discharge coolant flow due.

14. A cooling system as recited in claim 1, and further wherein the first discharge coolant flow is less than the second discharge coolant flow.

15. A cooling system for use in a direct chilled casting mold system with a mold cavity, the mold system being configured for molding a metal castpart, the cooling system comprising:

a cooling framework configured for location around a perimeter of a mold cavity, the cooling framework comprising:

a first plurality of coolant discharge apertures configured at a first end to receive coolant at a first coolant flow rate, and configured at a second end to discharge a first discharge coolant flow at a first coolant discharge velocity toward a first fractional surface portion of a castpart being molded;

a second plurality of coolant discharge apertures configured at a first end to receive coolant at a second coolant flow rate, and configured at a second end to discharge a second discharge coolant flow at a second coolant discharge velocity toward a second fractional surface portion of the castpart;

wherein the first coolant flow rate is approximately equal to the second coolant flow rate; and wherein the first discharge flow rate is lower than the second discharge flow rate.

16. A cooling system as recited in claim 15, and further wherein the first coolant discharge velocity is less than the second coolant discharge velocity.

17. A cooling system as recited in claim 15, and further wherein the coolant comprises water.

18. A cooling system as recited in claim 15, and further wherein the coolant is a mixture of water and a gas.

19. A cooling system as recited in claim 15, and further wherein the first fractional surface portion is a center portion and the second fractional surface portion is a quarter portion.

20. A cooling system as recited in claim 15, and further wherein the first fractional surface portion is a center portion and the second fractional surface portion is a one-third portion.

21. A cooling system as recited in claim 15, and further wherein the first fractional surface portion and the second fractional surface portion are adjacent one another around the perimeter of a mold cavity.

22. A cooling system as recited in claim 15, and further wherein the first fractional surface portion and the second fractional surface portion are spaced apart from one another around the perimeter of a mold cavity.

23. A cooling system as recited in claim 15, and further wherein the casting mold system is configured to cast an ingot shaped castpart.

24. A cooling system as recited in claim 15, and further wherein the first coolant flow rate is within four percent of the second coolant flow rate.

25. A cooling system as recited in claim 15, and further wherein the first coolant flow rate is within eight percent of the second coolant flow rate.

26. A cooling system as recited in claim 15, and further wherein the first coolant flow rate is within twelve percent of the second coolant flow rate.

27. A cooling system as recited in: claim 15, and further wherein heat transfer from the castpart to the first discharge coolant flow is less than heat transfer to the second discharge coolant flow due.

28. A cooling system for use in a direct chilled casting mold system with a mold cavity, the mold system being configured for molding a metal castpart, the cooling system comprising:

a cooling framework configured for location around a perimeter of a mold cavity, the cooling framework comprising:

a first plurality of coolant discharge apertures configured at a first end to receive coolant at a first coolant flow rate, and configured at a second end to discharge a first discharge coolant flow at a first coolant discharge velocity toward a first fractional surface portion of a castpart being molded;

a second plurality of coolant discharge apertures configured at a first end to receive coolant at a second coolant flow rate, and configured at a second end to discharge a second discharge coolant flow at a second coolant discharge velocity toward a second fractional surface portion of the castpart;

wherein the first coolant flow rate is approximately equal to the second coolant flow rate; wherein the first discharge coolant flow creates a higher average steam stain on the first fractional surface portion than the second discharge coolant flow creates on the second fractional surface portion of the castpart.

29. A cooling system as recited in claim 28, and further wherein the first fractional surface portion is a center portion and the second fractional surface portion is a quarter portion.

30. A cooling system as recited in claim 28, and further wherein the first fractional surface portion is a center portion and the second fractional surface portion is a one-third portion.

31. A cooling system as recited in claim 28, and further wherein the first fractional surface portion and the second fractional surface portion are adjacent one another around the perimeter of a mold cavity.

32. A cooling system as recited in claim 28, and further wherein the first fractional surface portion and the second fractional surface portion are spaced apart from one another around the perimeter of a mold cavity.

33. A cooling system as recited in claim 28, and further wherein the coolant comprises water.

34. A cooling system for use in a direct chilled casting mold system with a mold cavity, the mold system being configured for molding a metal castpart, the cooling system comprising:

a cooling framework configured for location around a perimeter of a mold cavity, the cooling framework comprising:

a first plurality of coolant discharge apertures configured at a first end to receive coolant at a first coolant flow rate, and configured at a second end to discharge a first discharge coolant flow at a first coolant discharge velocity toward a first fractional surface portion of a castpart being molded;

a second plurality of coolant discharge apertures configured at a first end to receive coolant at a second coolant flow rate, and configured at a second end to discharge a second discharge coolant flow at a second coolant discharge velocity toward a second fractional surface portion of the castpart;

wherein the first coolant flow rate is approximately equal to the second coolant flow rate; further wherein the first plurality of coolant discharge apertures discharge the first discharge coolant and the second plurality of coolant discharge apertures discharge the second discharge coolant; and still further wherein heat transfer to the first discharge coolant flow is less than heat transfer to the second discharge coolant flow.

35. A direct chilled casting mold with a mold cavity configured for casting a metal castpart, and a cooling system, the cooling system comprising:

a cooling framework configured for location around a perimeter of the mold cavity, the cooling framework comprising:

a first plurality of coolant discharge apertures configured at a first end to receive coolant at a first coolant flow rate, and configured at a second end to discharge a first discharge coolant flow toward a center surface portion of a castpart being molded;

a second plurality of coolant discharge apertures configured at a first end to receive coolant at a second coolant flow rate, and configured at a second end to discharge a second discharge coolant flow toward a fractional surface portion of the castpart;

wherein the first coolant flow rate is approximately equal to the second coolant flow rate; further wherein the first plurality of coolant discharge apertures discharge the first discharge coolant and the second plurality of coolant discharge apertures discharge the second discharge coolant; and still further wherein the first discharge coolant flow is discharged relative to the second discharge coolant flow such that less heat is transferred to the first discharge coolant flow than to the second discharge coolant flow.

* * * * *